US007483000B2

(12) United States Patent
Lee et al.

(10) Patent No.: US 7,483,000 B2
(45) Date of Patent: Jan. 27, 2009

(54) APPARATUS AND METHOD FOR DRIVING A PLASMA DISPLAY PANEL

(75) Inventors: Joo-Yul Lee, Ahsan (KR); Kyoung-Ho Kang, Ahsan (KR); Hee-Hwan Kim, Cheonan (KR)

(73) Assignee: Samsung SDI Co., Ltd., Suwon-si (KR)

( * ) Notice: Subject to any disclaimer, the term of this patent is extended or adjusted under 35 U.S.C. 154(b) by 465 days.

(21) Appl. No.: 11/256,401

(22) Filed: Oct. 21, 2005

(65) Prior Publication Data

US 2006/0033685 A1 Feb. 16, 2006

Related U.S. Application Data

(63) Continuation of application No. 10/210,766, filed on Jul. 31, 2002, now Pat. No. 6,963,174.

(30) Foreign Application Priority Data

Aug. 6, 2001 (KR) ..... 2001-47311
Mar. 13, 2002 (KR) ..... 2002-13573

(51) Int. Cl.
*G09G 3/28* (2006.01)
*G09G 3/10* (2006.01)

(52) U.S. Cl. ..... 345/60; 345/66; 315/169.4

(58) Field of Classification Search ..... 345/60–70; 315/169.4

See application file for complete search history.

(56) References Cited

U.S. PATENT DOCUMENTS 4,866,349 A 9/1989 Weber et al.

(Continued)

FOREIGN PATENT DOCUMENTS

EP 0 261 584 A2 3/1998

(Continued)

OTHER PUBLICATIONS

Patent Abstracts of Japan for Publication No. 09-297563, Date of publication of application Nov. 18, 1997, in the name of Takashi Nose et al.

(Continued)

*Primary Examiner*—Bipin Shalwala
*Assistant Examiner*—Steven E Holton
(74) *Attorney, Agent, or Firm*—Christie, Parker & Hale, LLP

(57) ABSTRACT

A plasma display panel sustain-discharge circuit. First and second signal lines for supplying first and second voltages and at least one inductor coupled between one end of the panel capacitor and a third voltage are formed. Energy is stored in the inductor through a path formed between the third voltage and the first signal line in a state where a voltage of one end of the panel capacitor is substantially fixed to the first voltage. The voltage of one end of the panel capacitor substantially decreases to the second voltage using resonance current generated between the inductor and the panel capacitor and the stored energy. Energy is stored in the inductor through a path formed between the third voltage and the second line in a state where a voltage of one end of the panel capacitor is substantially fixed to the second voltage. The voltage of one end of the panel capacitor substantially increases to the first voltage using the resonance current generated between the inductor and the panel capacitor and the stored energy.

16 Claims, 25 Drawing Sheets

U.S. PATENT DOCUMENTS

| | | | | | |
|---|---|---|---|---|---|
| 5,081,400 | A | | 1/1992 | Weber et al. | |
| 5,642,018 | A | | 6/1997 | Marcotte | |
| 5,786,794 | A | | 7/1998 | Kishi et al. | |
| 5,828,353 | A | * | 10/1998 | Kishi et al. | 345/55 |
| 5,936,598 | A | | 8/1999 | Hayama et al. | |
| 6,011,355 | A | | 1/2000 | Nagai | |
| 6,028,573 | A | * | 2/2000 | Orita et al. | 345/66 |
| 6,150,999 | A | | 11/2000 | Chen et al. | |
| 6,400,343 | B1 | | 6/2002 | Zorzan et al. | |
| 6,483,490 | B1 | | 11/2002 | Lo | |
| 6,617,802 | B2 | | 9/2003 | Roh | |
| 6,633,285 | B1 | | 10/2003 | Kigo et al. | |
| 6,727,659 | B2 | | 4/2004 | Kim et al. | |
| 2001/0005188 | A1 | | 6/2001 | Watanabe | |
| 2001/0054994 | A1 | | 12/2001 | Hsu et al. | |
| 2002/0047577 | A1 | | 4/2002 | Roh et al. | |

FOREIGN PATENT DOCUMENTS

| | | |
|---|---|---|
| EP | 1 065 650 A2 | 1/2001 |
| JP | 9-297563 | 11/1997 |
| JP | 10-149135 | 6/1998 |
| JP | 11-344948 | 12/1999 |
| JP | 11-352927 | 12/1999 |
| JP | 2000-047634 | 2/2000 |

OTHER PUBLICATIONS

European Search report, dated Aug. 1, 2003, for Application No. 02017000.7-2205, in the name of Samsung SDI Co., Ltd.

* cited by examiner

APPARATUS AND METHOD FOR DRIVING A PLASMA DISPLAY PANEL

CROSS REFERENCE TO RELATED APPLICATIONS

The present invention is a continuation of U.S. application Ser. No. 10/210,766, filed Jul. 31, 2002, now U.S. Pat. No. 6,963,174 which claims priority to and the benefit of Korean Patent Application No. 2001-0047311 filed on Aug. 6, 2001 and Korean Patent Application No. 2002-0013573 filed on Mar. 13, 2002.

BACKGROUND OF THE INVENTION (a) Field of the Invention

The present invention relates to an apparatus and a method for driving a plasma display panel (PDP) and, in particular, a PDP sustain-discharge circuit.

(b) Description of the Related Art

In general, a plasma display panel (PDP) is a flat plate display for displaying characters or images using plasma generated by gas discharge. Pixels ranging from hundreds of thousands to more than millions are arranged in the form of a matrix according to the size of the PDP. PDPs are divided into direct current (DC) PDPs and alternating current (AC) PDPs according to the shape of the waveform of an applied driving voltage, and the structure of a discharge cell.

Current directly flows in discharge spaces while a voltage is applied in the DC PDP, because electrodes are exposed to the discharge spaces. Therefore, a resistor for restricting the current must be used outside of the DC PDP. On the other hand, in the case of the AC PDP, the current is restricted due to the natural formation of capacitance because a dielectric layer covers the electrodes. The AC PDP has a longer life than the DC PDP because the electrodes are protected against the shock caused by ions during discharge. A memory characteristic that is one of the important characteristics of the AC PDP is caused by the capacitance due to the dielectric layer that covers the electrodes.

In general, a method for driving the AC PDP includes a reset period, an addressing period, a sustain period, and an erase period.

The reset period is for initializing the states of the respective cells in order to smoothly perform an addressing operation on the cells. The addressing period is for selecting cells that are turned on and cells that are not turned on and for accumulating wall charges on the cells that are turned on (addressed cell). The sustain period is for performing discharge for actually displaying a picture on the addressed cells. The erase period is for reducing the wall charge of the cell and for terminating sustain-discharge.

In the AC PDP, because scan electrodes and sustain electrodes for the sustain-discharge operate as capacitive load, capacitance with respect to the scan and sustain electrodes exists. Reactive power other than power for discharge is necessary in order to apply waveforms for the sustain-discharge. A power recovering circuit for recovering and re-using the reactive power is referred to as a sustain-discharge circuit of the PDP. The sustain-discharge circuit suggested by L. F. Weber and disclosed in the U.S. Pat. Nos. 4,866,349 and 5,081,400 is the sustain-discharge circuit or the power recovery circuit of the AC PDP.

However, the conventional sustain-discharge circuit can completely operate only when the power recovery circuit charges a voltage corresponding to half of the external power in order to re-use power using the resonance of an inductor and the capacitive load (a panel capacitor). In order to uniformly sustain the potential of the power recovery capacitor, the capacitance of an external capacitor must be much larger than the capacitance of the panel capacitor. Accordingly, a structure of a driving circuit is complicated and a large amount of devices must be used in manufacturing the driving circuit.

SUMMARY OF THE INVENTION

In accordance with the present invention a PDP driving circuit is provided which is capable of recovering power.

In a first aspect of the present invention, a PDP driving circuit includes first and second signal lines for supplying first and second voltages and at least one inductor coupled between one end of the panel capacitor and a third voltage.

A first current path is formed in a state where one end of the panel capacitor is substantially sustained to be the first voltage. The first current path couples the first signal line to the inductor so that current of a first direction is supplied to the inductor and first energy is stored. A second current path is formed, which generates a resonance between the inductor and the panel capacitor and substantially decreases a voltage of one end of the panel capacitor to the second voltage using current caused by the resonance and the first energy. A third current path is formed in a state where one end of the panel capacitor is substantially sustained to be the second voltage. The third current path couples the second signal line to the inductor so that current of a second direction opposite to the first direction is supplied to the inductor and second energy can be stored. A fourth current path is formed, which generates a resonance between the inductor and the panel capacitor and substantially increases a voltage of one end of the panel capacitor to the first voltage using current caused by the resonance and the second energy.

Energy may remain in the inductor when a voltage of one end of the panel capacitor is changed into the first and second voltages. Fifth and sixth current paths for recovering the energy remaining in the inductor are preferably further comprised when the voltage of one end of the panel capacitor is changed into the first and second voltages.

The currents of the first and second directions can pass through the same inductor. The inductor may include a first inductor, through which the current of the first direction passes, and a second inductor, through which the current of the second direction passes.

The first and second signal lines are preferably connected to one end of the panel capacitor so that the voltage of one end of the panel capacitor is sustained to be the first and second voltages.

The PDP driving circuit preferably further includes first and second switching elements formed on the first and second signal lines and operating so that the first and third current paths are respectively formed, and third and fourth switching elements connected to each other between the inductor and the third voltage in parallel and operating so that first and second current paths and third and fourth current paths are formed. The first and second switching elements preferably include body diodes.

The third voltage preferably corresponds to a half of the sum of the first and second voltages.

The first and second voltages preferably have the same magnitude and electric potentials that are opposite to each other, and the third voltage is preferably a ground voltage.

The PDP driving circuit preferably further includes a capacitor whose one end is selectively coupled to a first power source supplying the first voltage and a ground. The first signal line is coupled to the first power source supplying the first voltage. The second signal line is coupled by the first power source to the other end of a capacitor charged by the first voltage.

In a second aspect of the present invention, a PDP driving circuit includes first and second signal lines for supplying a first voltage and a second voltage of a level opposite to the level of the first voltage, and at least an inductor coupled between one end of the panel capacitor and a ground.

A first current path is formed between one end of the panel capacitor substantially fixed to the first voltage by the first signal line and ground. The first current path generates a resonance between the inductor and the panel capacitor, and substantially decreasing a voltage of one end of the panel capacitor to the second voltage by the resonance current. A second current path is formed between one end of the panel capacitor substantially fixed to the second voltage by the second signal line and ground. The second current path generates a resonance between the inductor and the panel capacitor and substantially increases a voltage of one end of the panel capacitor to the first voltage by the resonance current.

The PDP driving circuit preferably further includes first and second switching elements connected to each other between ground and the inductor in parallel and operating so that the first and second current paths are formed, and third and fourth switching elements formed on the first and second signal lines and operating so that a voltage of one end of the panel capacitor is fixed to the first and second voltages. The third and fourth switching elements preferably include body diodes.

In a third aspect of the present invention, a PDP driving circuit includes first and second switching elements, which are serially connected to each other between a first signal line and a second signal line respectively supplying a first voltage and a second voltage having opposite levels and whose contact point is coupled to one end of the panel capacitor, at least one inductor coupled to one end of the panel capacitor, and third and fourth switching elements connected to each other between ground and the inductor in parallel.

In a fourth aspect of the present invention, a PDP driving circuit includes first and second switching elements, which are serially connected to each other between first and second signal lines respectively supplying first and second voltages and whose contact point is coupled to one end of the panel capacitor, at least one inductor coupled to one end of the panel capacitor, and third and fourth switching elements connected to each other between a third voltage that is an intermediate voltage of the first and second voltages and the inductor in parallel. First and second energies are stored in the inductor through first and second current paths formed through the third voltage and the first and second signal lines, and the panel capacitor is discharged and charged using the first and second energies.

In third and fourth aspects of the present invention, a PDP driving circuit further includes a capacitor whose one end is selectively coupled to the power source supplying the first voltage and ground. The first signal line is coupled to the power source. The second signal line is coupled by the power source to the other end of the capacitor charged by the first voltage.

According to a method for driving the PDP in accordance with the present invention, energy is stored in the inductor through a path formed between a third voltage that is a voltage between the first and second voltages and the first signal line in a state where a voltage of one end of the panel capacitor is substantially fixed to the first voltage. A voltage of one end of the panel capacitor substantially decreases to the second voltage using resonance current generated between the inductor and the panel capacitor and the stored energy. Energy is stored in the inductor through a path formed between the third voltage and the second line in a state where a voltage of one end of the panel capacitor is substantially fixed to the second voltage. A voltage of one end of the panel capacitor substantially increases to the first voltage using the resonance current generated between the inductor and the panel capacitor and the stored energy.

Energy remaining in the inductor is preferably recovered after the voltage of one end of the panel capacitor is changed into the second and first voltages, respectively.

DETAILED DESCRIPTION OF THE INVENTION

A plasma display panel (PDP) according to an embodiment of the present invention and a method for driving the PDP will now be described in detail with reference to the attached drawings.

Figure 1:
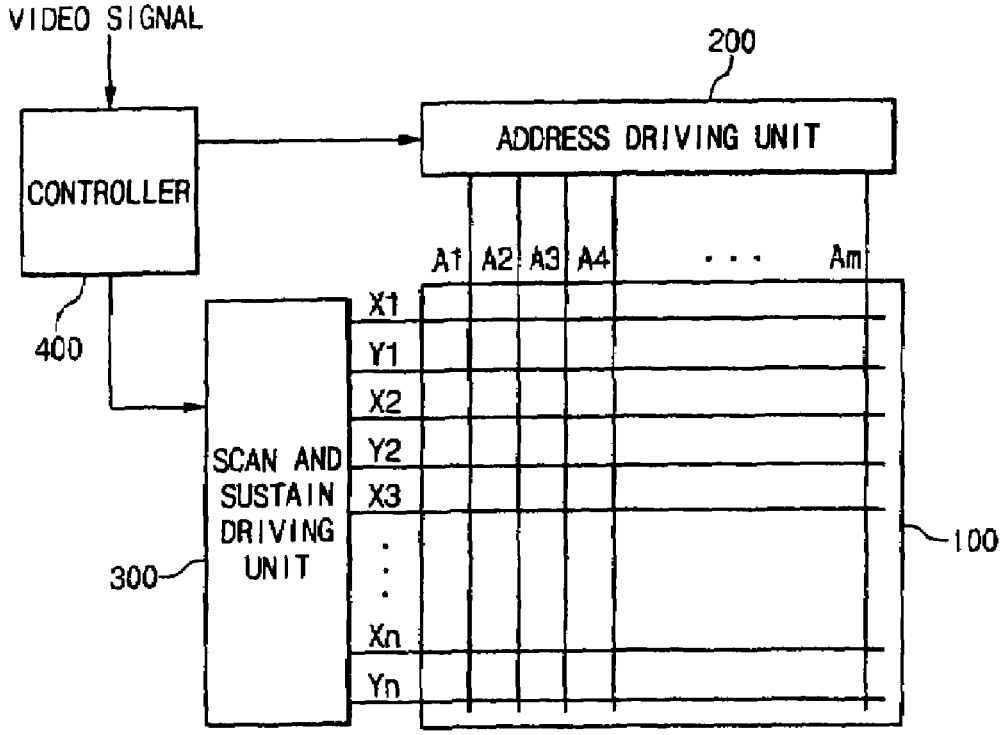
FIG. 1 shows a PDP which can implement embodiments in accordance with the present invention.

FIG. 1 shows a PDP which can implement various embodiments of the present invention.

As shown in FIG. 1, the PDP which can implement the present invention includes plasma panel 100, address driving unit 200, scan and sustain driving unit 300, and controller 400.

Plasma panel 100 includes a plurality of address electrodes A1 through Am arranged in a column direction, a plurality of scan electrodes Y1 through Yn (Y electrodes) arranged in a zigzag pattern in a row direction, and a plurality of sustain electrodes X1 through Xn (X electrodes). X electrodes X1 through Xn are formed to correspond to Y electrodes Y1 through Yn. In general, one side ends are commonly connected to each other.

Address driving unit 200 receives an address driving control signal from controller 400 and applies a display data signal for selecting a discharge cell to be displayed, to the respective address electrodes. Scan and sustain driving unit 300 includes sustain-discharge circuit 320. Sustain-discharge circuit 320 receives a sustain-discharge signal from controller 400 and alternately inputs a sustain pulse voltage to the Y electrodes and the X electrodes. Sustain-discharge occurs in the discharge cell selected by the received sustain pulse voltage.

Controller 400 receives a video signal from the outside, generates the address driving control signal and the sustain-discharge signal, and applies the address driving control signal and the sustain-discharge signal to address driving unit 200 and scan and sustain driving unit 300, respectively.

The sustain-discharge circuit 320 according to a first embodiment of the present invention will now described in detail with reference to FIGS. 2 and 3.

Figure 2:
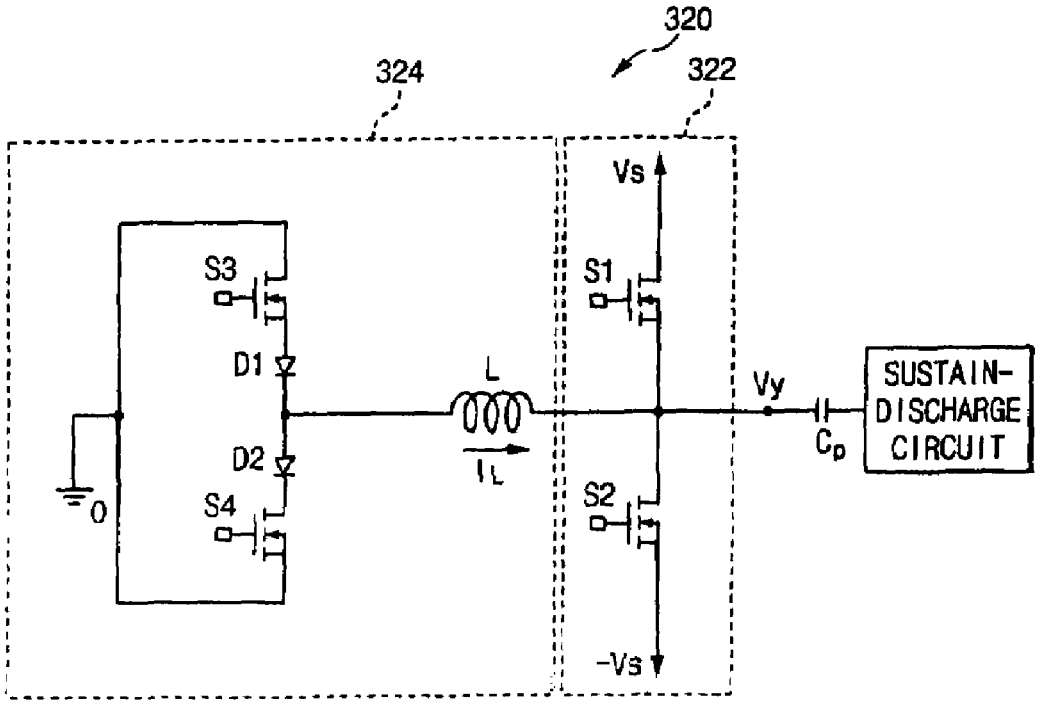
FIGS. 2 and 4 are circuit diagrams showing the PDP sustain-discharge circuits according to first and second embodiments of the present invention.

FIG. 2 is a circuit diagram showing the sustain-discharge circuit of the PDP according to the first embodiment of the present invention. FIG. 3 is a timing diagram showing the driving of the sustain-discharge circuit of the PDP according to the first embodiment of the present invention.

As shown in FIG. 2, sustain-discharge circuit 320 according to the first embodiment of the present invention includes sustain-discharge unit 322 and power recovering unit 324. Sustain-discharge unit 322 includes switching elements S1 and S2 serially connected to each other between power source Vs and power source −Vs. The contact point of switching elements S1 and S2 is connected to an electrode (assumed to be a Y electrode) of a plasma panel (a panel capacitor Cp because the plasma panel operates as capacitive load). Power sources Vs and −Vs supply voltages corresponding to Vs and −Vs. Another sustain-discharge circuit is connected to another electrode of panel capacitor Cp.

The power recovering unit 324 includes inductor L connected to the contact point of switching elements S1 and S2 and switching elements S3 and S4. Switching elements S3 and S4 are connected to each other in parallel between the other end of inductor L and ground. Also, power recovering unit 324 can further include diodes D1 and D2 respectively formed on a path between switching element S3 and inductor L and on a path between switching element S4 and inductor L.

The switching elements S1, S2, S3, and S4 included in sustain-discharge unit 322 and power recovering unit 324 are shown as MOSFETs in FIG. 2. However, the switching elements are not restricted to the MOSFETs and other types of switching elements may be used if the other types of the switching elements perform the same or similar functions. The switching elements preferably include body diodes. One example of a switching element with a body diode is a MOSFET with an integral body diode as commonly depicted in FIG. 30.

The operation of sustain-discharge circuit 320 according to the first embodiment of the present invention will now be described with reference to FIG. 3.

Because switching element S2 is turned on before the operation according to the first embodiment is performed, Y electrode voltage Vy of panel capacitor Cp is substantially sustained to be −Vs.

Figure 3:
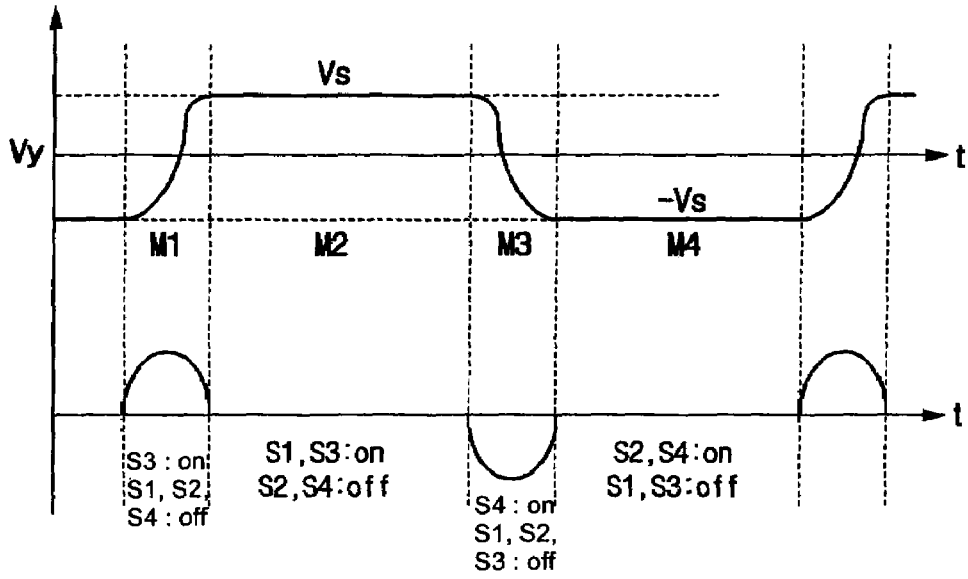
FIGS. 3, 5, 9, and 11 are timing diagrams showing the driving of PDP sustain-discharge circuits according to first through fourth embodiments.

As shown in FIG. 3, because switching elements S1, S2, and S4 are turned off and switching element S3 is turned on in a mode 1 (M1), an LC resonance is generated in a path of ground, switching element S3, diode D1, inductor L, and panel capacitor Cp. Resonance current $I_L$ that flows through inductor L by the LC resonance forms a half period of a sine wave. At this time, Y electrode voltage Vy increases from −Vs to Vs.

In a mode 2 (M2), switching element S1 is turned on when Y electrode voltage Vy increases to Vs. Accordingly, Y electrode voltage Vy is sustained to be Vs by power source Vs. Switching element S3 can be turned off at this time or in a mode 3 (M3).

In the mode 3 (M3), switching element S4 is turned on. Accordingly, the LC resonance is generated in a path of panel capacitor Cp, inductor L, diode D2, switching element S4, and ground. Resonance current $I_L$ that flows through inductor L by the LC resonance forms the half period of the sine wave. At this time, Y electrode voltage Vy decreases from Vs to −Vs.

In a mode 4 (M4), when Y electrode voltage Vy decreases to −Vs, switching element S2 is turned on. Accordingly, Y electrode voltage Vy is sustained to −Vs by power source −Vs. Switching element S4 can be turned off at this time or in the repeated model (M1).

Vs and −Vs can be alternately applied to the Y electrode of the panel capacitor by repeating mode 1 through mode 4. When the sustain-discharge circuit for applying Vs and −Vs in a polarity opposite to that of the first embodiment is connected to other electrodes (the X electrodes), a voltage loaded on both ends of panel capacitor Cp becomes a voltage 2Vs required for the sustain-discharge. Accordingly, the sustain-discharge may occur in a panel.

According to the first embodiment of the present invention, it is possible to change the voltage of panel capacitor Cp using the voltage charged to panel capacitor Cp. That is, because current for charging or discharging the panel capacitor needs not be applied from an external power source, unnecessary power is not used.

An embodiment where power source unit 326 for supplying power sources Vs and −Vs to the sustain-discharge circuit according to the first embodiment of the present invention is added will now be described with reference to FIGS. 4 through 6.

Figure 4:
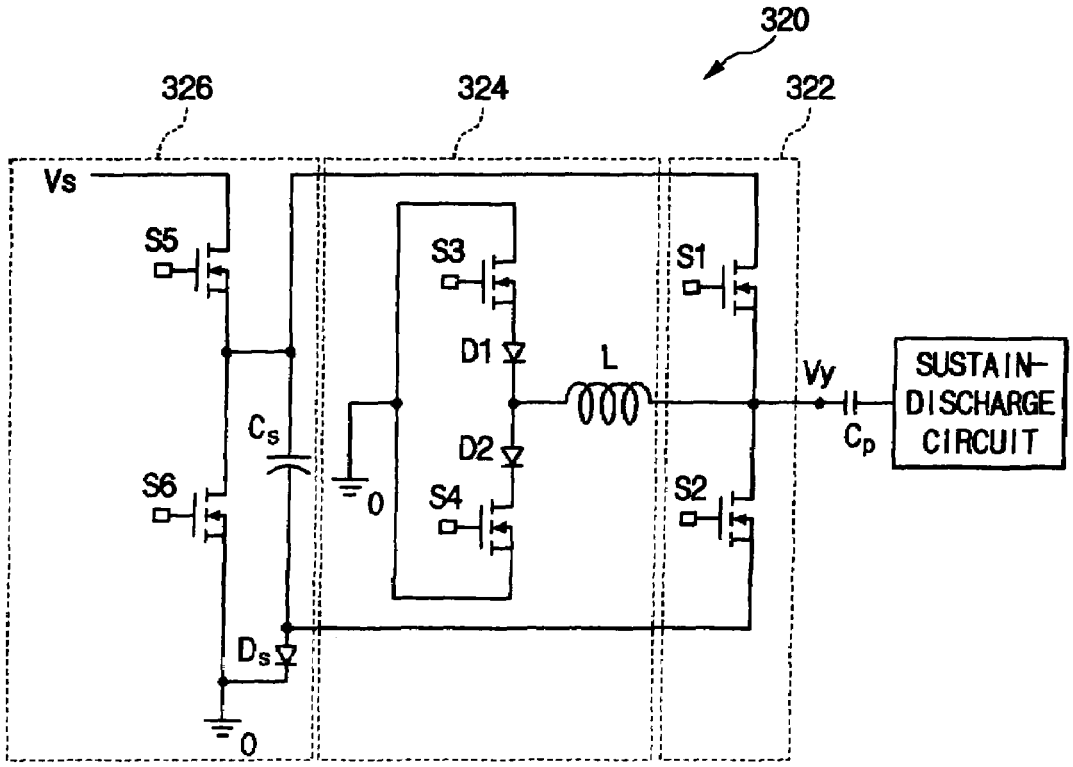

FIG. 4 is a circuit diagram of a sustain-discharge circuit of a PDP according to a second embodiment of the present invention. FIG. 5 is a timing diagram showing the driving of the sustain-discharge circuit according to the second embodiment of the present invention. FIG. 6 shows a circuit obtained by modifying the sustain-discharge circuit according to the second embodiment of the present invention.

As shown in FIG. 4, sustain-discharge circuit 320 according to the second embodiment of the present invention further includes power source unit 326. Power source unit 326 includes switching elements S5 and S6. Switching elements S5 and S6 are serially connected to each other between power source Vs and ground. Capacitor Cs is connected between the contact point of switching elements S5 and S6 and switching element S2 of sustain-discharge unit 322. The contact point of switching elements S5 and S6 is connected to switching element S1. Diode Ds is connected between capacitor Cs and ground. Accordingly, voltage −Vs can be applied to panel capacitor Cp using the voltage charged to capacitor Cs without a power source −Vs.

The operation of the sustain-discharge circuit according to the second embodiment of the present invention will now be described with reference to FIG. 5 on the basis of a difference between the first embodiment and the second embodiment.

Figure 5:
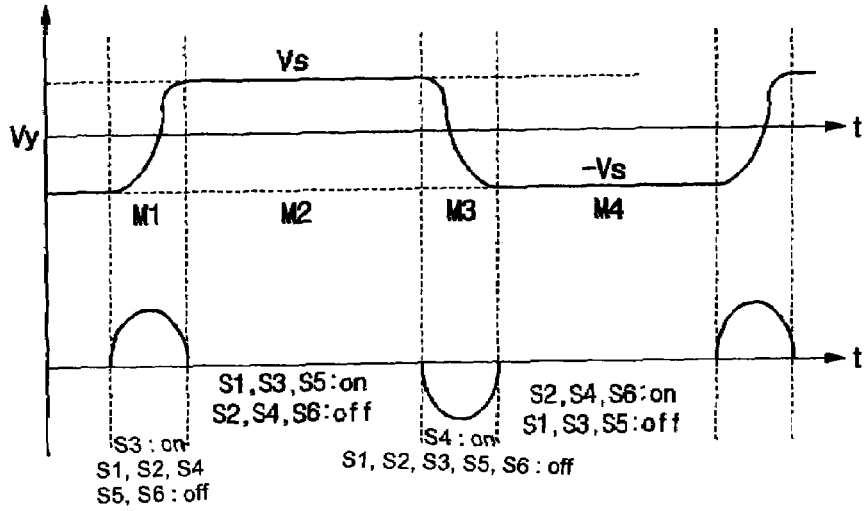

As shown in FIG. 5, the driving time according to the second embodiment of the present invention is the same as that of the first embodiment excepting that voltages Vs and −Vs are applied to the Y electrode of panel capacitor Cp by the operations of switching elements S5 and S6.

To be more specific, switching elements S5 and S6 are turned off in the modes 1 and 3 (M1) and (M3), that is, in the step of changing the voltage of panel capacitor Cp. In the mode 2 (M2), Y electrode voltage Vy of panel capacitor Cp is sustained to be voltage Vs by turning on switching element S5 in a state where switching element S6 is turned off. Voltage Vs is charged to capacitor Cs through a path of power source Vs, switching element S5, capacitor Cs, diode Ds, and ground. In the mode 4 (M4), a path of ground, switching element S6, capacitor Cs, switching element S2, and panel capacitor Cp is formed by turning on switching element S6 in a state where switching element S5 is turned off. Voltage −Vs is applied to the Y electrode of panel capacitor Cp by voltage Vs charged to capacitor Cs through the path. Y electrode voltage Vy of panel capacitor Cp can maintain voltage −Vs.

According to the second embodiment of the present invention, it is possible to apply voltage −Vs to panel capacitor Cp without using a power source Vs for supplying voltage −Vs.

Figure 31:
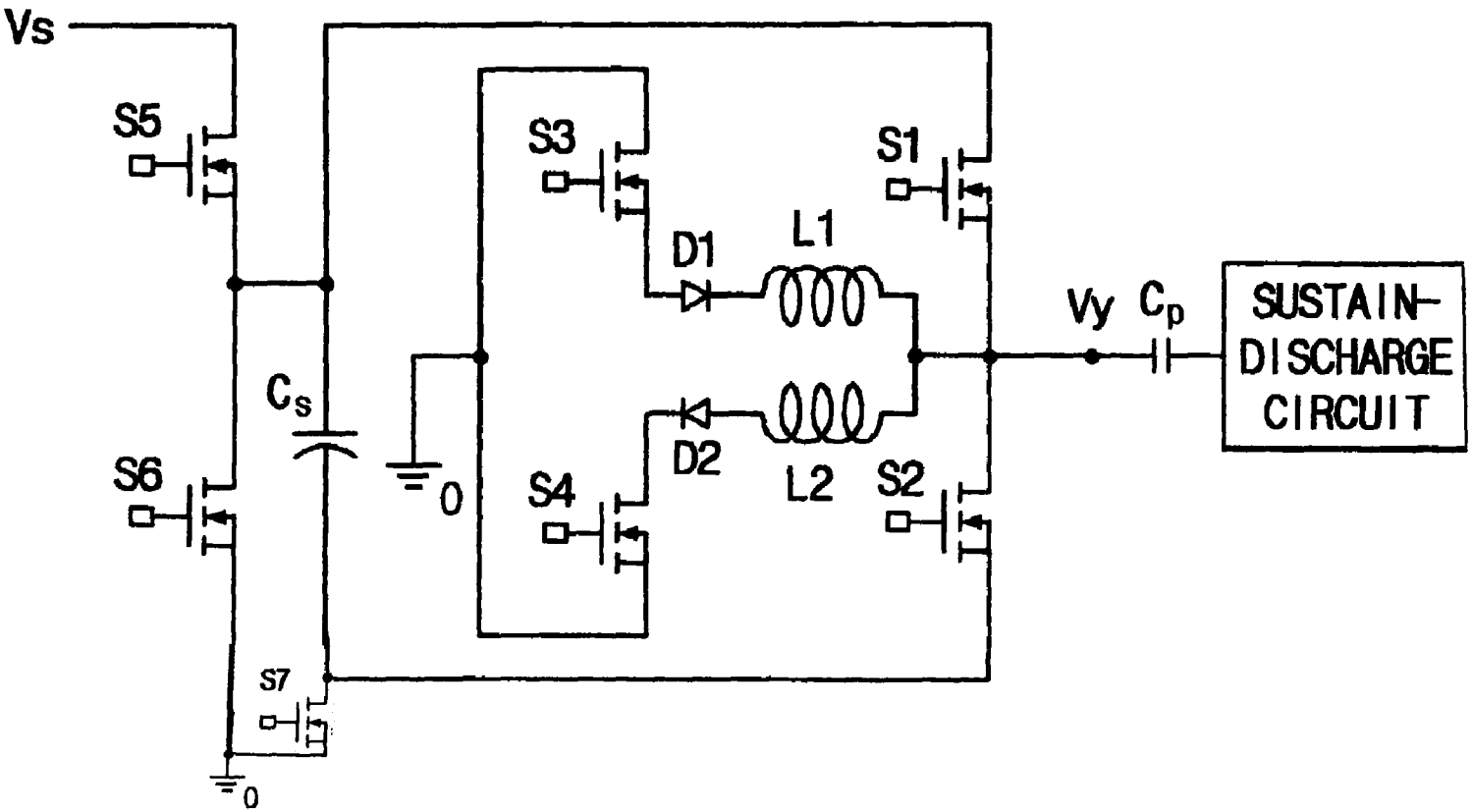

In the second embodiment of the present invention, diode Ds is used in order to form the path for charging voltage Vs to capacitor Cs. However, as shown in FIG. 6, switching element S7 can be used instead of diode Ds as shown in FIG. 6. Such an alternative embodiment is also depicted in FIG. 31. That is, a path is formed by turning on switching element S7 when voltage Vs is charged to capacitor Cs in the mode 2 (M2). In other cases, the path is intercepted by turning off switching element S7.

Figure 6:
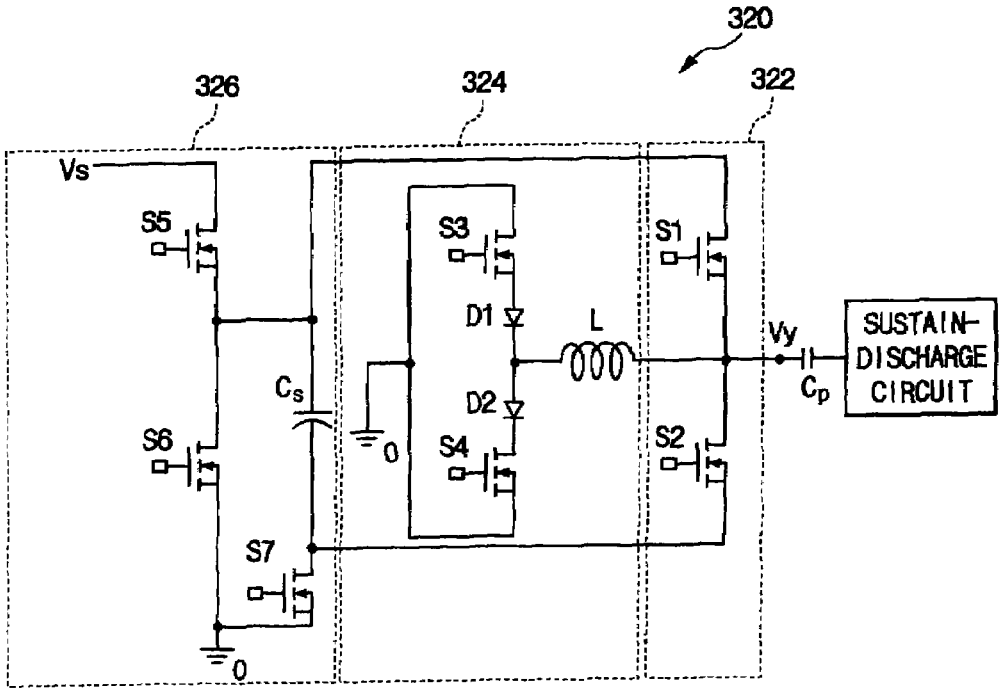
FIG. 6 shows a circuit obtained by modifying the PDP sustain-discharge circuit according to the second embodiment.
Figure 30:
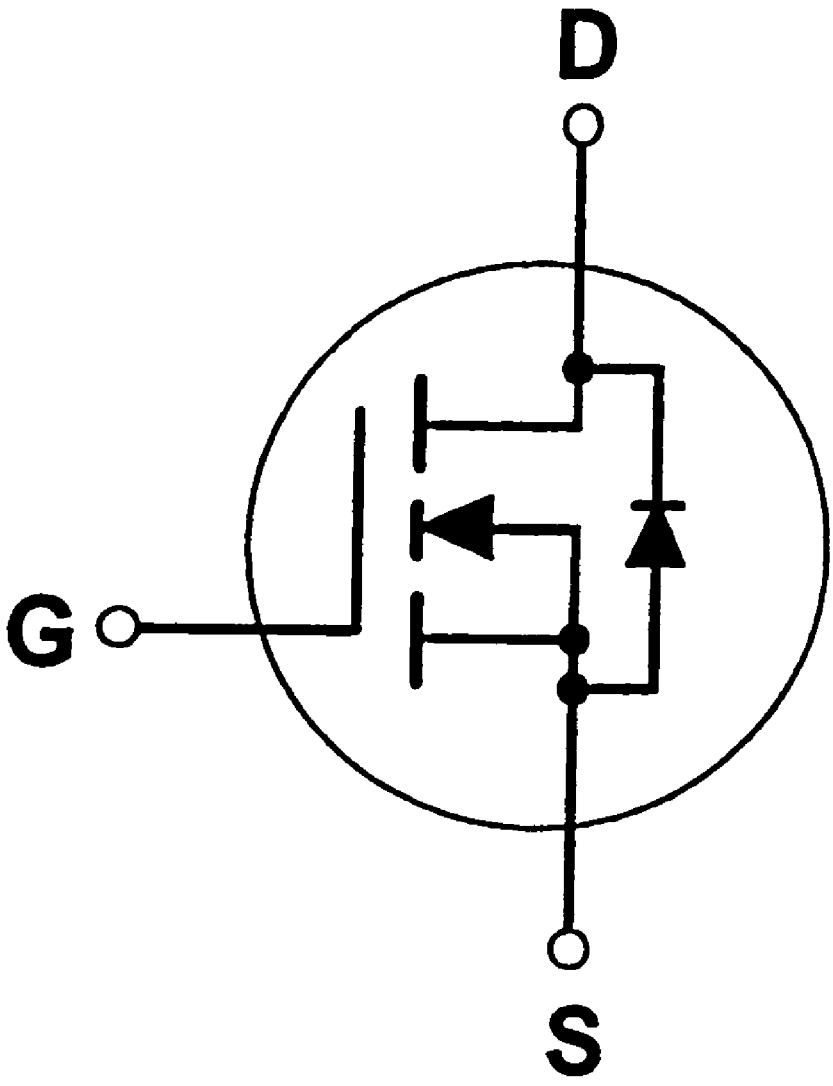
FIG. 30 shows a schematic representation of a switch element MOSFET with integral body diode.

Switching elements S5, S6, and S7 used by power source unit 326 are shown as MOSFETs in FIGS. 4 and 6. However, any switching elements that perform the same or similar functions can be used as the MOSFETs. The switching elements preferably include body diodes, such as the MOSFETs with integral body diodes as depicted in FIG. 30.

Figure 7:
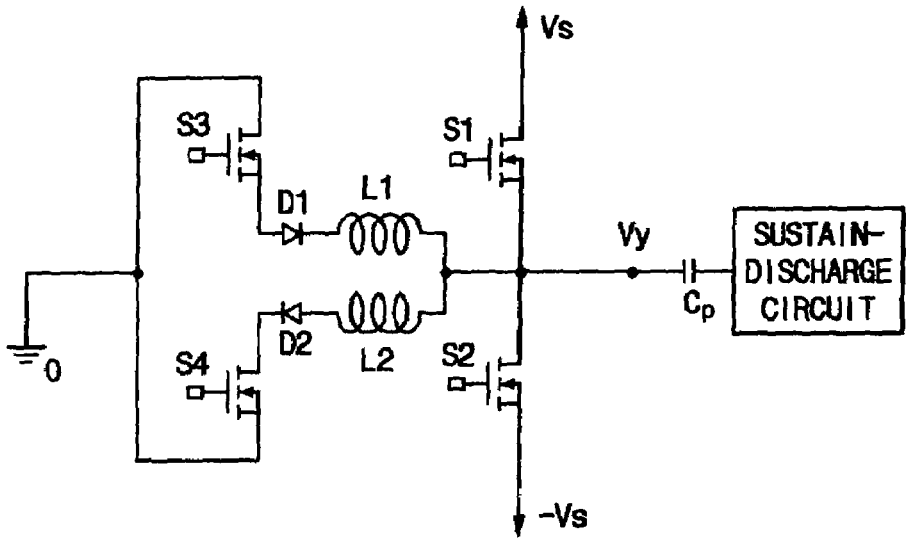
FIGS. 7 and 8 shows circuits obtained by modifying the PDP sustain-discharge circuits according to the first and second embodiments of the present invention.
Figure 8:
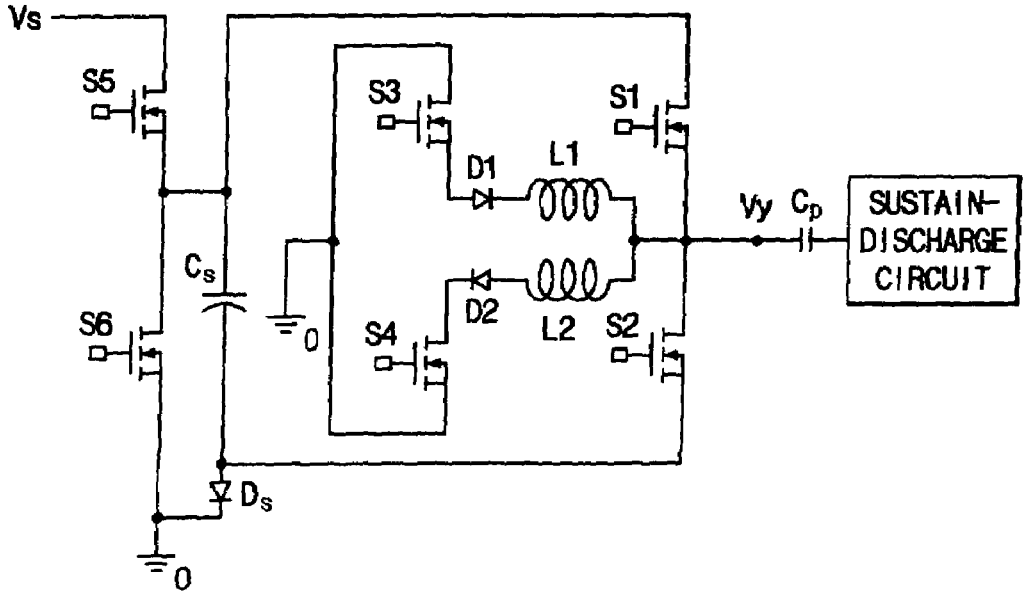

Inductor L is used in the first and second embodiments of the present invention. Two inductors L1 and L2 can be used as shown in FIGS. 7 and 8. That is, inductor L1 can be used in the path formed from ground to the panel capacitor and inductor L2 can be used in the path formed from panel capacitor Cp to ground.

An embodiment where the sustain-discharge circuits according to the first and second embodiments are driven by another driving timing will be described with reference to FIGS. 9 through 12.

Figure 9:
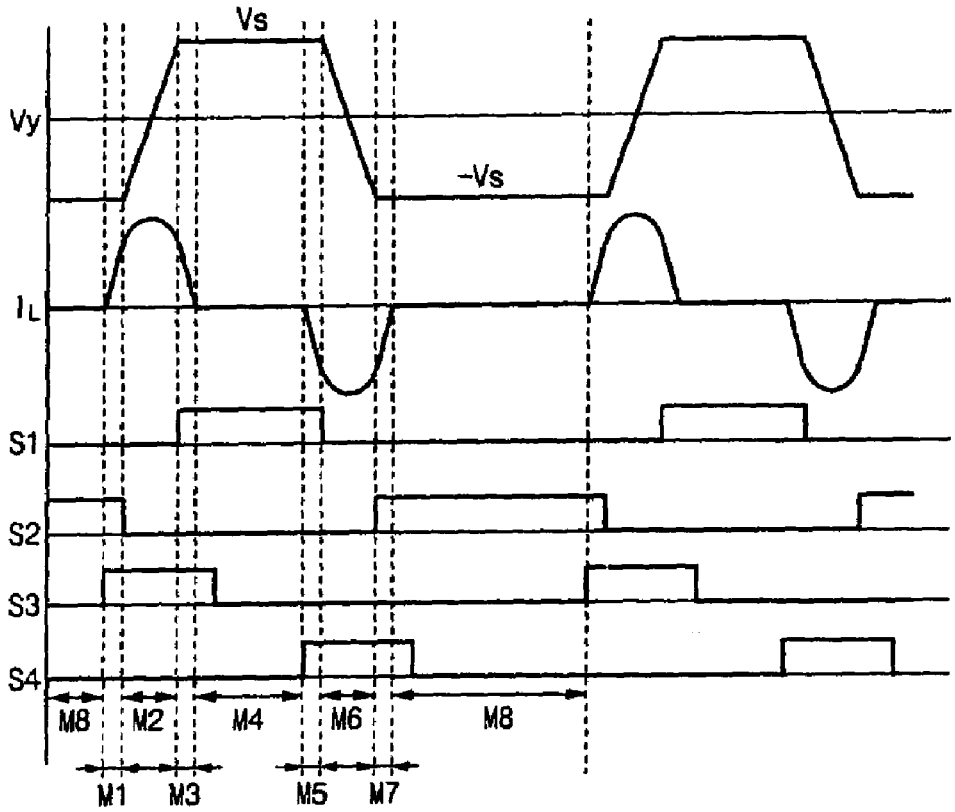
Figure 10A:
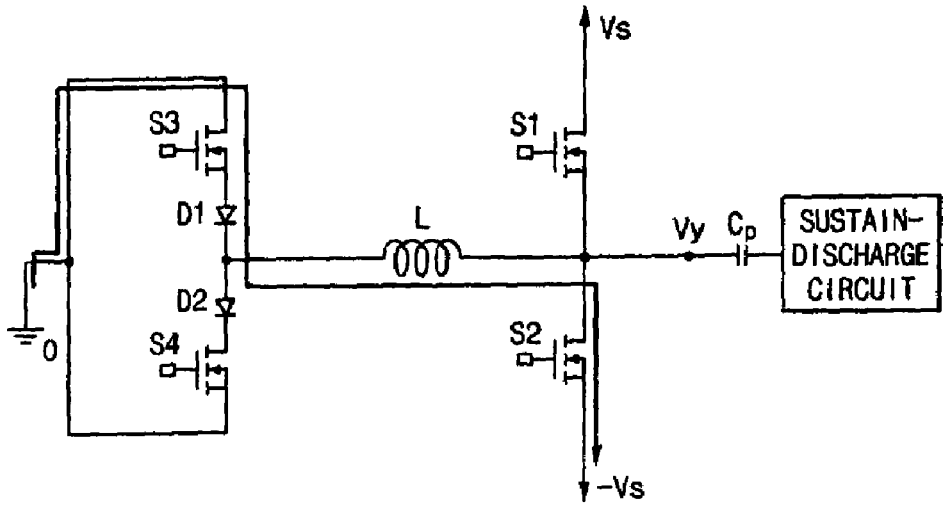
FIGS. 10A through 10H show the current paths of the respective modes in the PDP sustain-discharge circuit according to the third embodiment of the present invention.
Figure 10B:
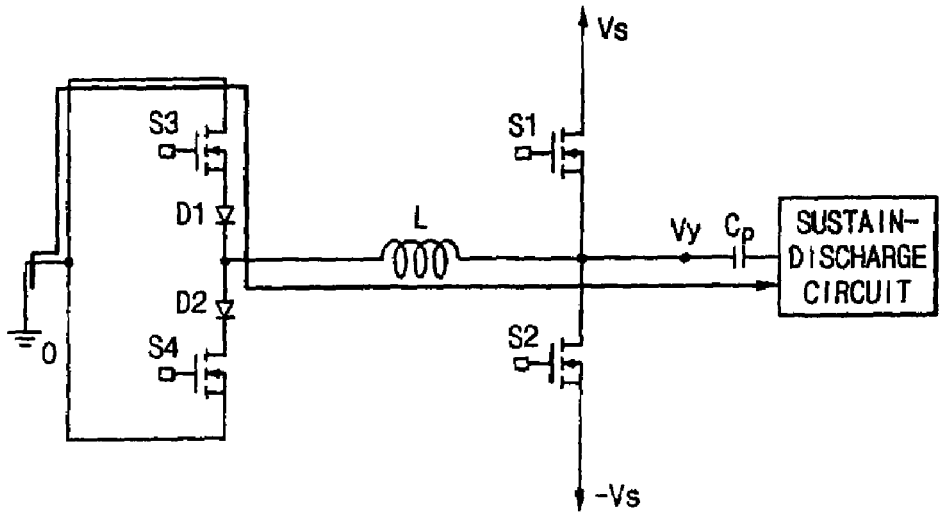
Figure 10C:
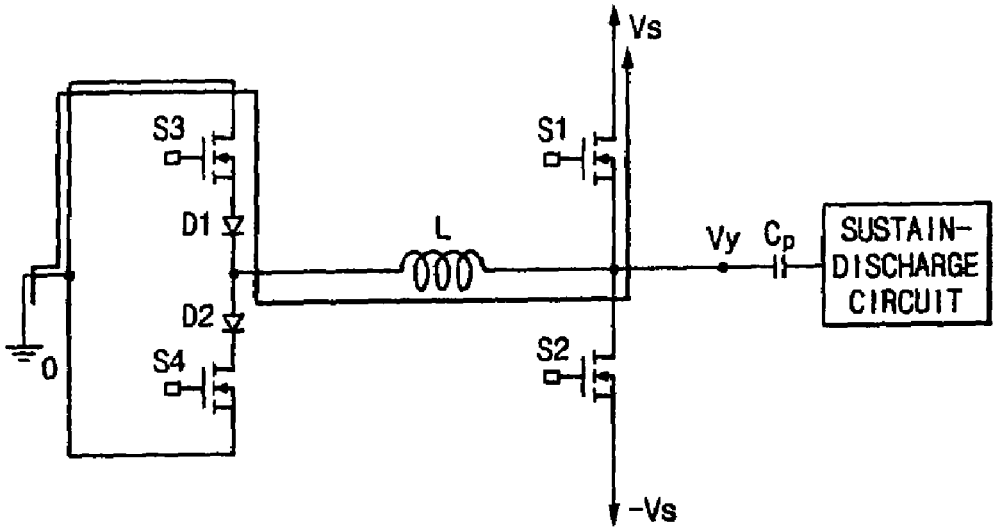
Figure 10D:
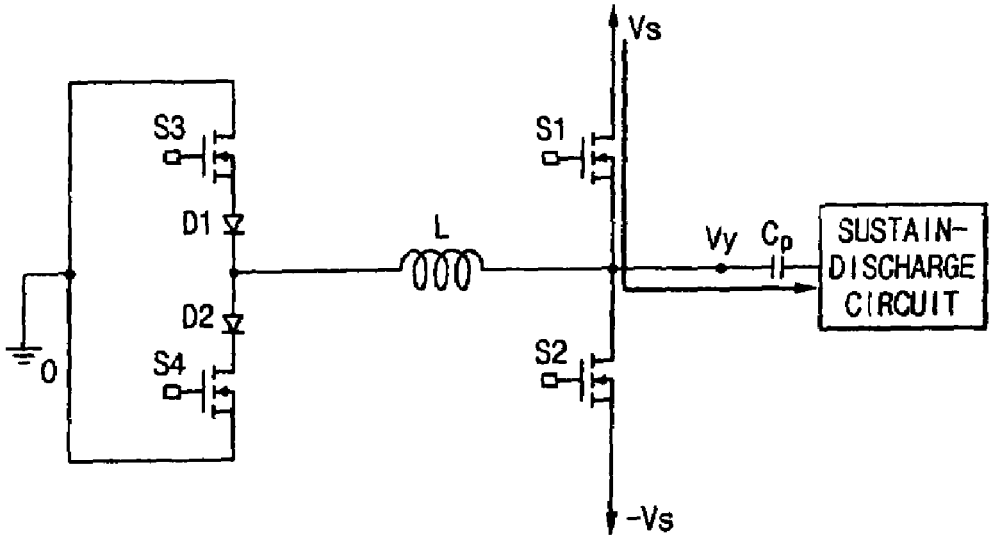
Figure 10E:
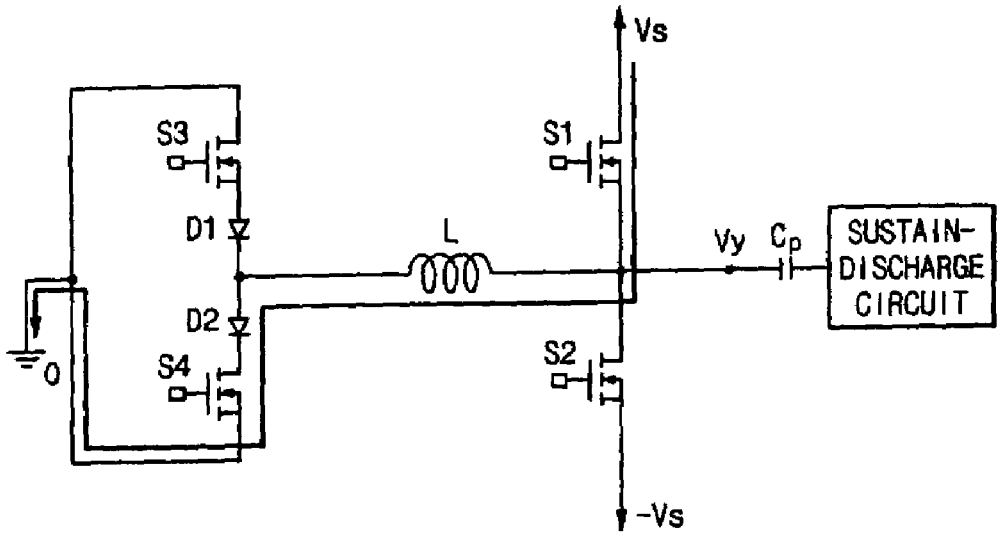
Figure 10F:
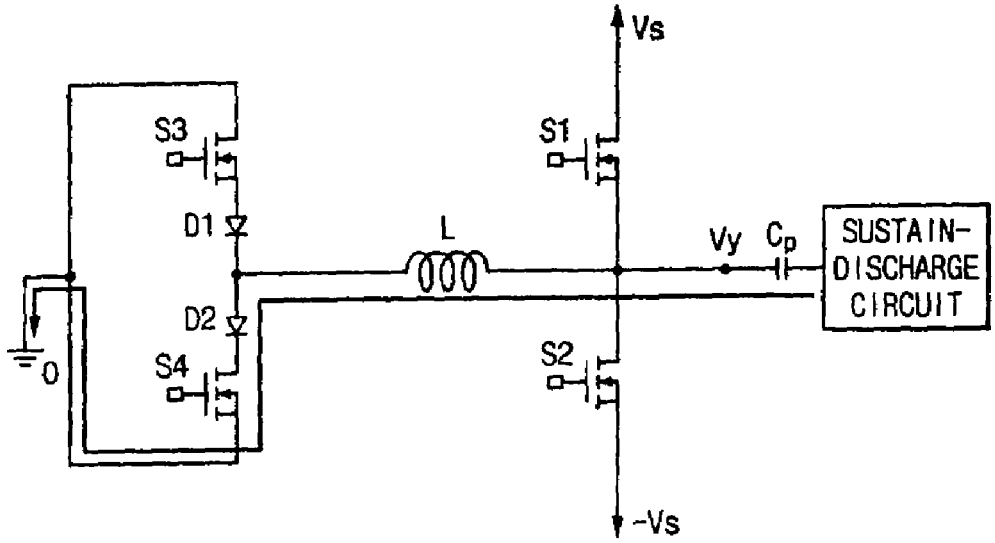
Figure 10G:
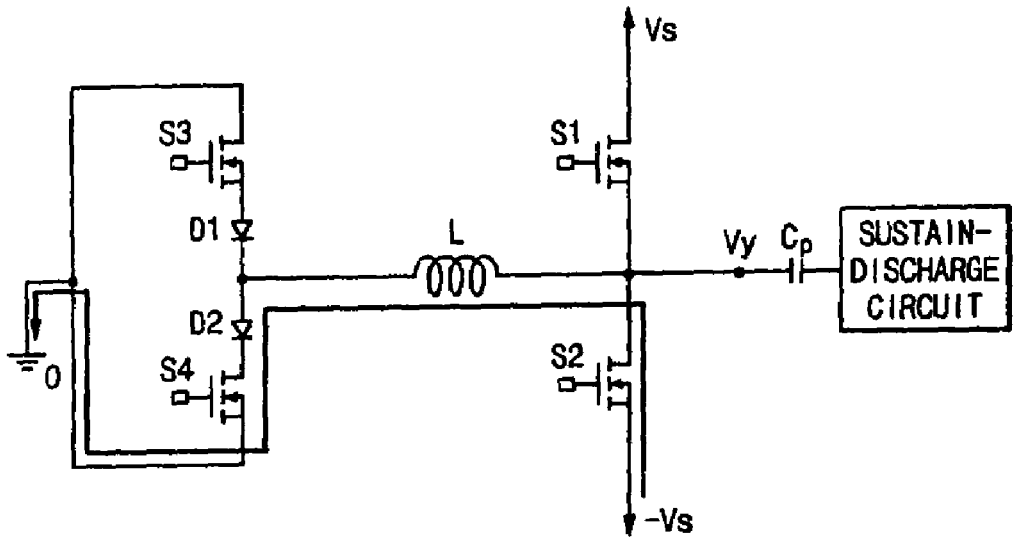
Figure 10H:
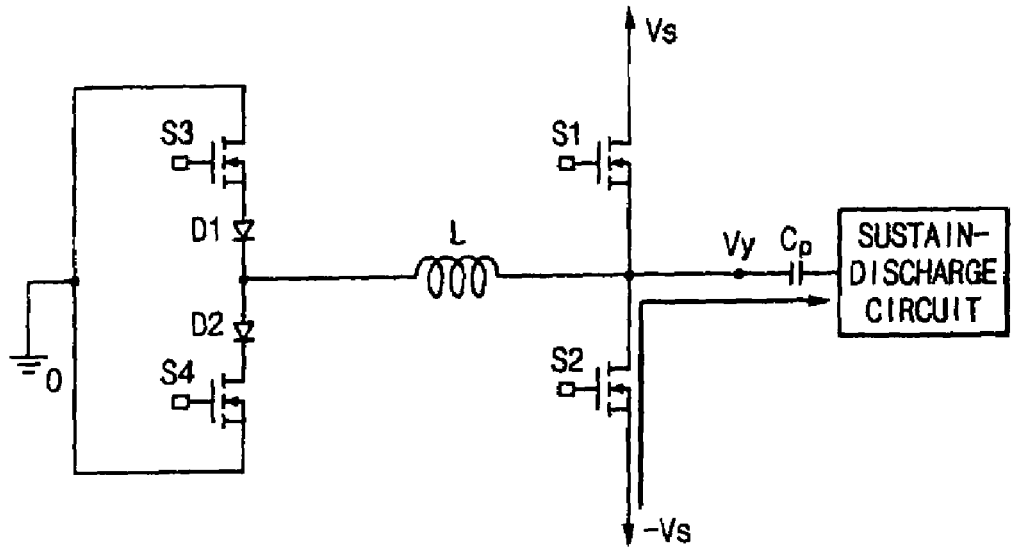
Figure 11:
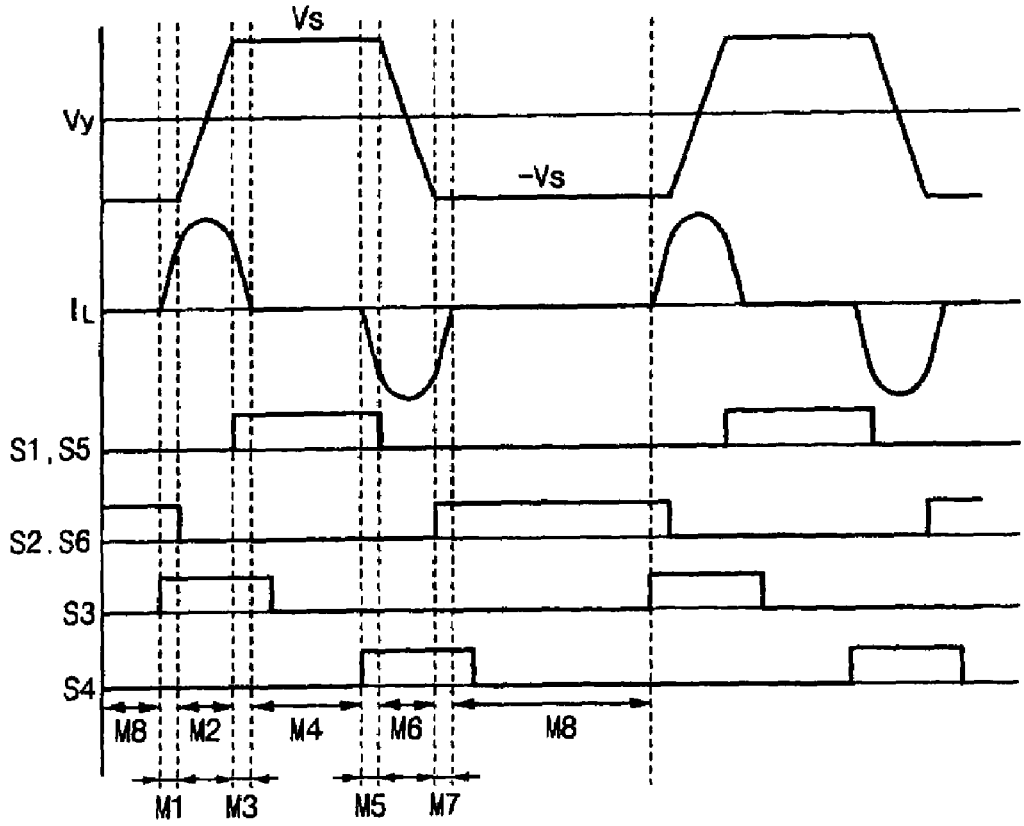

FIGS. 9 and 11 are timing diagrams showing the driving of sustain-discharge circuits according to third and fourth embodiments of the present invention. FIGS. 10A through 10H show the current paths of the respective modes in the sustain-discharge circuit according to the third embodiment of the present invention. FIGS. 12A through 12H show the current paths of the respective modes in the sustain-discharge circuit according to the fourth embodiment.

The sustain-discharge circuit according to the third embodiment of the present invention has the same circuit as that of the first embodiment. Before performing the operation according to the third embodiment of the present invention, it is set that Y electrode voltage Vy of panel capacitor Cp is sustained to be −Vs because switching element S2 is turned on.

Referring to FIGS. 9 and 10A, in the mode 1 (M1), because switching element S3 is turned on in a state where switching element S2 is turned on, a current path of switching element S3, diode D1, inductor L, switching element S2, and power −Vs is formed. Because current $I_L$ that flows through inductor L by the current path linearly increases, energy is accumulated in inductor L.

In the mode 2 (M2), switching element S2 is turned off in a state where switching element S3 is turned on. When switching element S2 is turned off, as shown in FIG. 10B, current $I_L$ that flows from inductor L to power source −Vs flows through panel capacitor Cp because the current path is intercepted. Accordingly, the LC resonance is generated by inductor L and panel capacitor Cp. Y electrode voltage Vy of panel capacitor Cp increases from voltage −Vs to voltage Vs due to the energy accumulated in the resonance current and the inductor.

In the mode 3 (M3), Y electrode voltage Vy of panel capacitor Cp reaches Vs and the body diode of switching element S1 conducts. Accordingly, as shown in FIG. 10C, a current path of switching element S3, diode D1, inductor L, body diode of switching element S1, and power source Vs is formed. Current $I_L$ that flows from inductor L to panel capacitor Cp is recovered to power source Vs and linearly decreases to 0A.

Also, Y electrode Vy of panel capacitor Cp is sustained to be voltage Vs by turning on switching element S1. At this time, because switching element S1 is turned on in a state where a voltage between a drain and a source is 0, switching element S1 can perform zero voltage switching. Accordingly, the turn-on switching loss of switching element S1 is not generated. Because the energy accumulated in inductor L is used in the third embodiment, it is possible to increase Y electrode voltage Vy to Vs even when a parasitic component exists in the sustain-discharge circuit. That is, the zero voltage switching can be performed even when the parasitic component exists in the circuit.

As shown in FIG. 10D, in the mode 4 (M4), switching element S1 continuously is turned on. Accordingly, Y electrode voltage Vy of panel capacitor Cp is continuously sustained to Vs and switching element S3 is turned off when current $I_L$ that flows through the inductor decreases to 0A.

In a mode 5 (M5), switching element S4 is turned on in a state where switching element S1 is turned on. Accordingly, as shown in FIG. 10E, a current path of power source Vs, switching element S1, inductor L, diode D2, switching element S4, and ground is formed. Current $I_L$ that flows through inductor L linearly increases in an opposite direction. Accordingly, energy is accumulated in inductor L.

In a mode 6 (M6), switching element S1 is turned off. Accordingly, as shown in FIG. 10F, the LC resonance path is formed from panel capacitor Cp to inductor L. Therefore, Y electrode voltage Vy of panel capacitor Cp decreases from voltage Vs to voltage −Vs by the energy accumulated in resonance current $I_L$ and inductor L.

In a mode 7 (M7), Y electrode voltage Vy reaches −Vs and the body diode of switching element S2 conducts. Accordingly, as shown in FIG. 10G, a current path of the body diode of switching element S2, inductor L, diode D2, switching element S4, and ground is formed. Therefore, current $I_L$ that flows through inductor L is recovered to ground and linearly decreases to 0A.

Also, switching element S2 is turned on in a state where the body diode conducts. Accordingly, Y electrode voltage Vy of panel capacitor Cp is sustained to −Vs. At this time, because switching element S2 is turned on in a state where the voltage between the drain and the source is 0, that is, because switching element S2 performs the zero voltage switching, the turn-on switching loss of switching element S2 is not generated.

As shown in FIG. 10H, in a mode 8 (M8), Y electrode voltage Vy is continuously sustained to −Vs by continuously turning on switching element S2 and switching element S4 is turned off when current $I_L$ that flows through the inductor decreases to 0A.

It is possible to alternately apply Vs and −Vs to the Y electrode of the panel capacitor by repeating the modes 1 through 8. When the sustain-discharge circuit for applying Vs and −Vs in a polarity opposite to that of the first embodiment is connected to other electrodes (the X electrodes), the voltage loaded on both ends of panel capacitor Cp becomes voltage 2Vs required for the sustain-discharge. Accordingly, the sustain-discharge may occur in the panel.

As mentioned above, in the third embodiment of the present invention, power is consumed in order to accumulate energy in the inductor in the modes 1 through 5. Power is recovered in the modes 3 through 7. Therefore, because the consumed power is ideally equal to the charged power, the consumed total power becomes 0W. Accordingly, it is possible to change the voltage of the panel capacitor without consuming the power. Because the energy accumulated in the inductor is used when the terminal voltage of the panel capacitor is changed, it is possible to perform the zero voltage switching when the parasitic component exists in the circuit.

A sustain-discharge circuit obtained by adding power source unit 326 for supplying power sources Vs and −Vs to the sustain-discharge circuit according to the second embodiment of the present invention will be described with reference to FIGS. 11 and 12A through 12H.

Sustain-discharge circuit 320 according to a fourth embodiment of the present invention has the same circuit as that of the second embodiment. It is set that Y electrode voltage Vy of panel capacitor Cp is sustained to −Vs by voltage Vs charged by capacitor Cs because capacitor Cs is charged by Vs before performing an operation according to the fourth embodiment, and switching elements S2 and S6 are turned on. Because the operation in the fourth embodiment is the same as the operation in the third embodiment excepting that voltages Vs and −Vs are supplied using switching elements S5 and S6, capacitor Cs, and diode Ds, the operations of switching elements S5 and S6 will be described in priority.

Figure 12A:
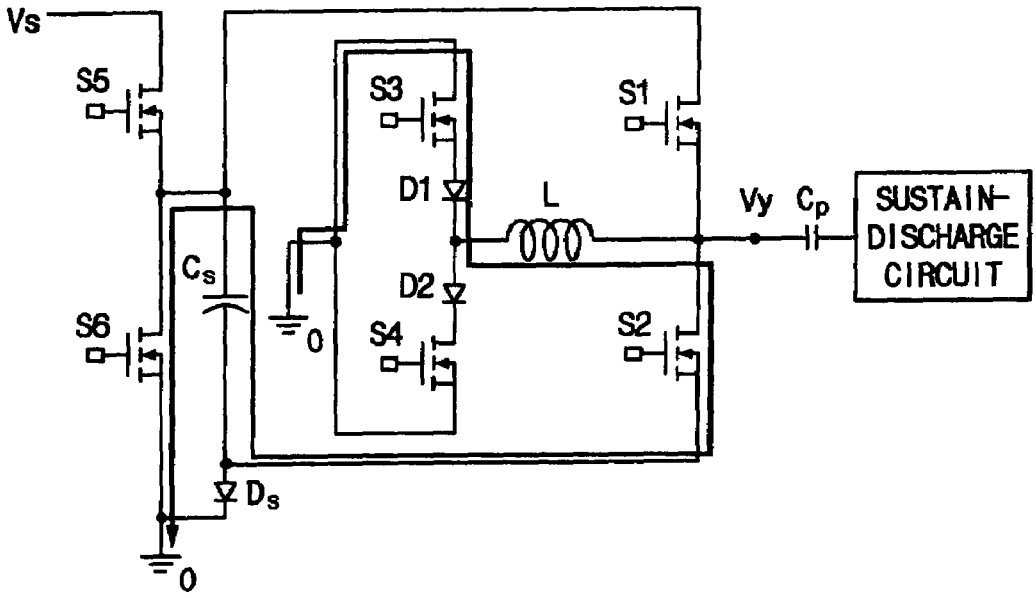
FIGS. 12A through 12H show the current paths of the respective modes in the PDP sustain-discharge circuit according to the fourth embodiment.
Figure 12B:
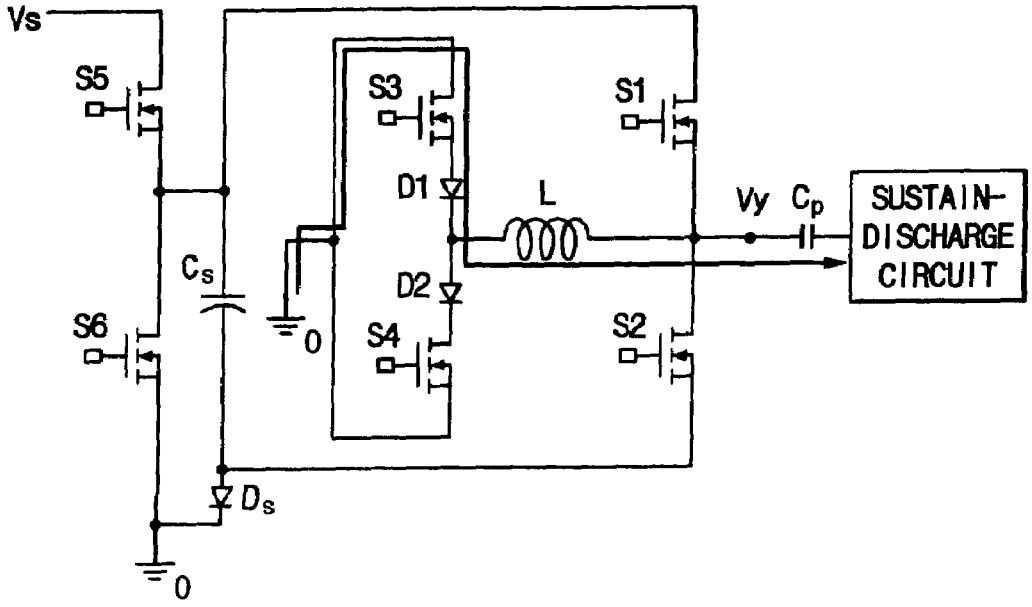

Referring to FIGS. 11 and 12A, in the mode 1 (M1), switching element S3 is turned on in a state where switching elements S2 and S6 are turned on. Accordingly, a current path of switching element S3, diode D1, inductor L, switching element S2, capacitor Cs, and switching element S6 is formed. Current $I_L$ that flows through inductor L linearly increases by the current path. Accordingly, energy is accumulated in inductor L.

In the mode 2 (M2), switching elements S2 and S6 are turned off in a state where switching element S3 is turned on. As described in the mode 2 of the third embodiment, Y electrode voltage Vy of panel capacitor Cp increases from voltage −Vs to voltage Vs by the energy accumulated in the resonance current and inductor L shown in FIG. 12B.

Figure 12C:
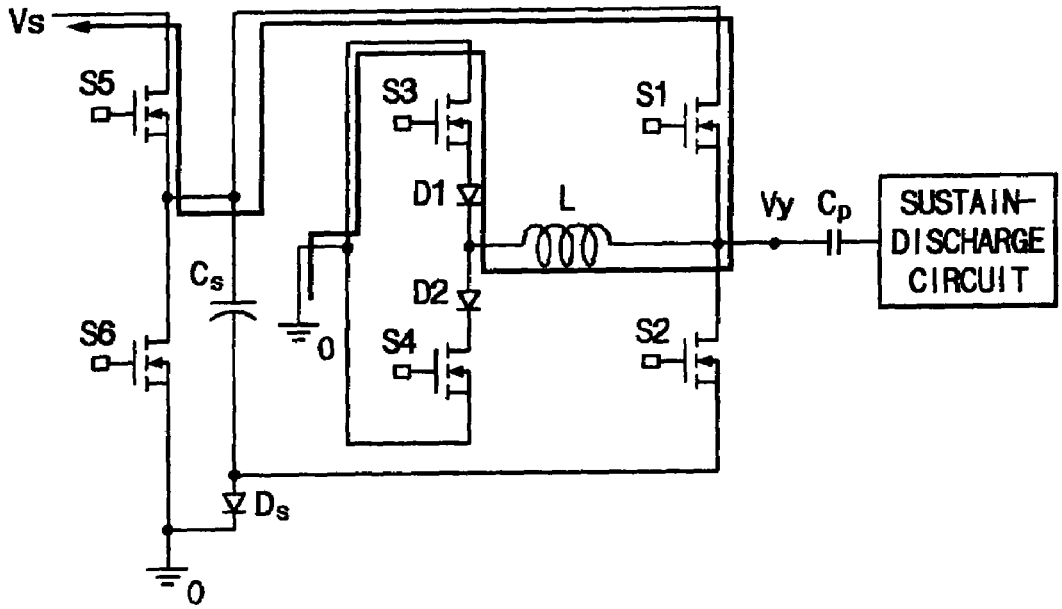

In the mode 3 (M3), as shown in FIG. 12C, a current path of switching element S3, diode D1, inductor L, the body diodes of switching elements S1 and S5, and power source Vs is formed. Accordingly, current $I_L$ that flows through inductor L is recovered to power source Vs. Also, Y electrode voltage Vy is sustained to be Vs by turning on switching elements S1 and S5 in a state where the body diode conducts. As described in the third embodiment, because switching elements S1 and S5 perform the zero voltage switching, the turn-on switching loss is not generated. Vs voltage is continuously charged to capacitor Cs by a path of power source Vs, switching element S5, capacitor C1, diode Ds, and ground, which is the same in the modes 4 and 5 (M4) and (M5) described hereinafter.

Figure 12D:
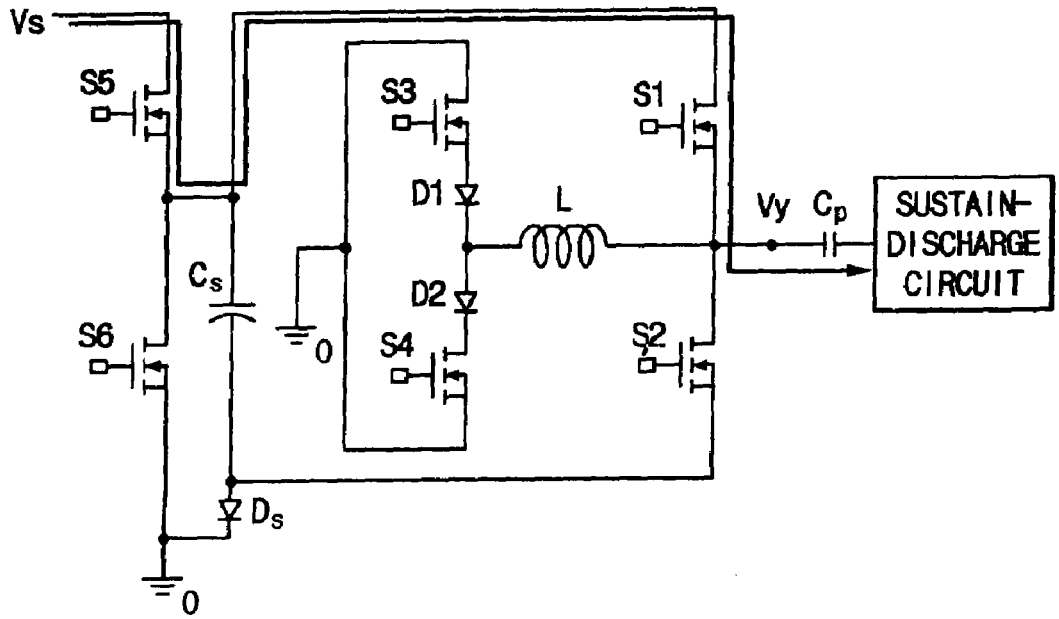

As shown in FIG. 12D, in the mode 4 (M4), Y electrode voltage Vy is continuously sustained to be Vs by continuously turning on switching elements S1 and S5. Switching element S3 is turned off after current $I_L$ that flows through the inductor decreases to 0A.

Figure 12E:
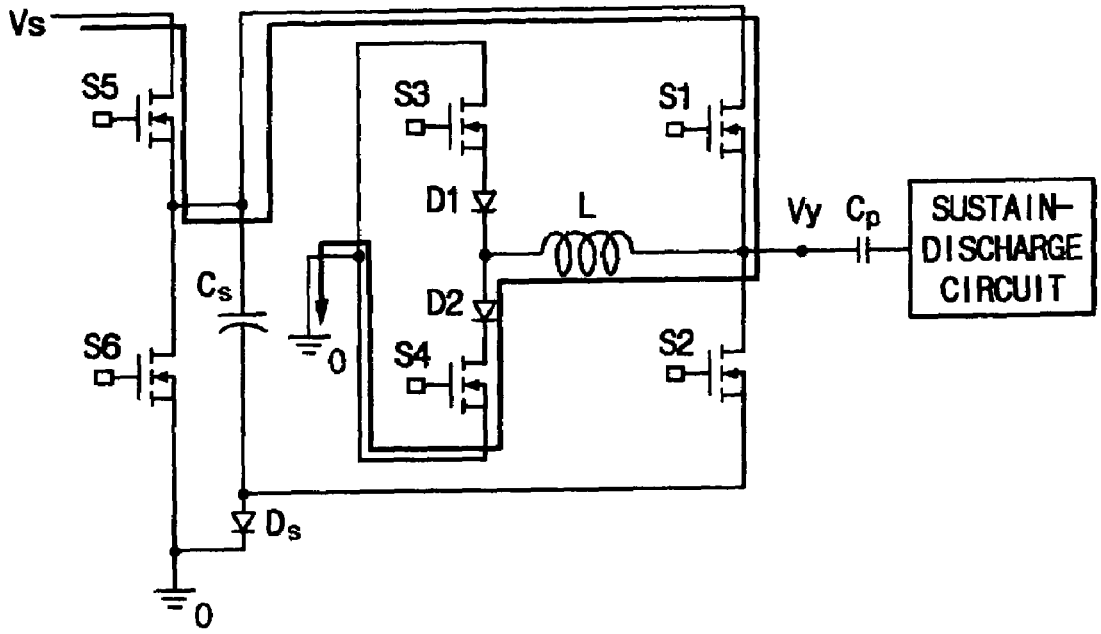

In the mode 5 (M5), switching element S4 is turned on in a state where switching elements S1 and S5 are turned on. Accordingly, as shown in FIG. 12E, a current path of power source Vs, switching elements S5 and S1, inductor L, diode D2, switching element S4, and ground is formed. Current $I_L$ that flows through inductor L linearly increases in an opposite direction. Accordingly, energy is accumulated in inductor L.

Figure 12F:
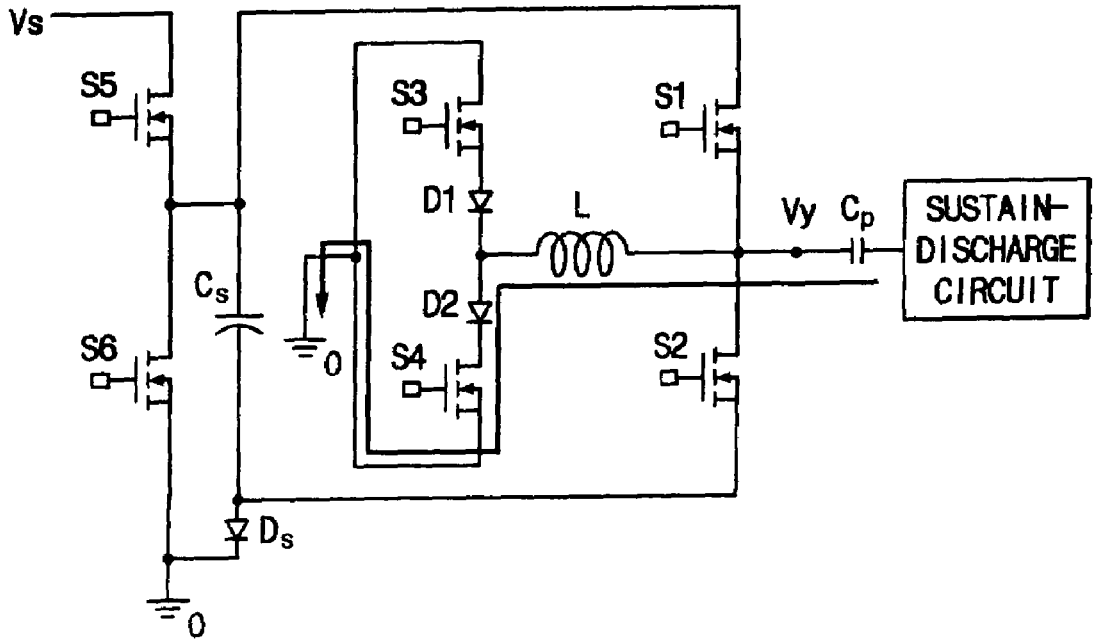

In the mode 6 (M6), switching elements S1 and S5 are turned off in a state where switching element S4 is turned on. Y electrode voltage Vy of panel capacitor Cp decreases from voltage Vs to voltage −Vs by the resonance current and the energy accumulated in inductor L, which are shown in FIG. 12F, as described in the mode 6 of the third embodiment.

Figure 12G:
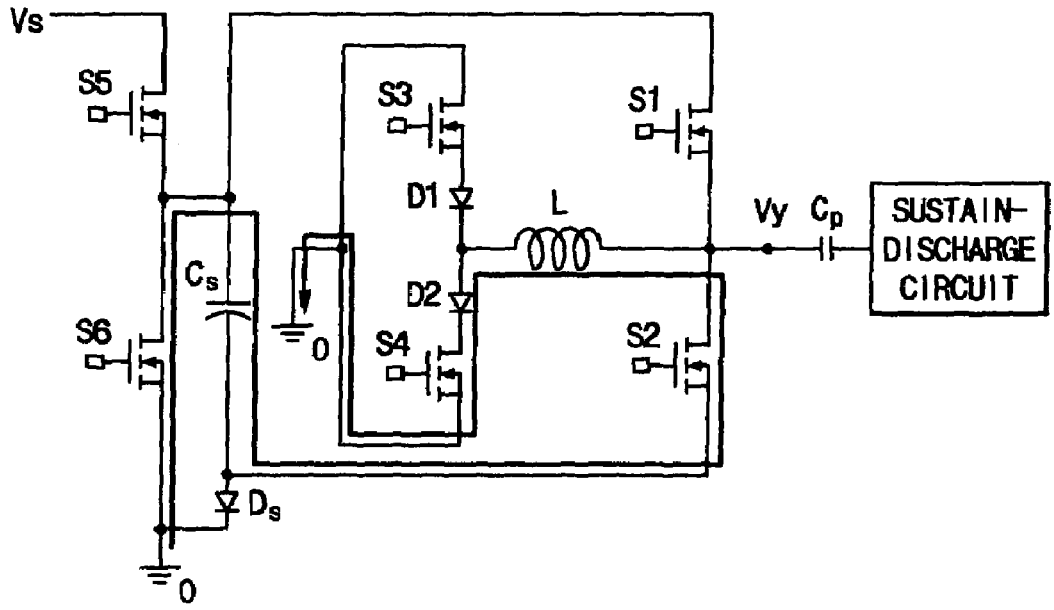

In the mode 7 (M7), a current path of switching element S6, capacitor Cs, body diode of switching element S2, inductor L, diode D2, switching element S4, and ground is formed as shown in FIG. 12G. Current $I_L$ that flows through inductor L flows through capacitor, Cs. Accordingly, the current is charged to capacitor Cs and linearly decreases to 0A.

The Y electrode voltage Vy is sustained to be −Vs because switching elements S2 and S6 are turned on in a state where the body diode conducts. Because switching elements S2 and S6 perform the zero voltage switching as described in the third embodiment, the turn-on switching loss is not generated.

Figure 12H:
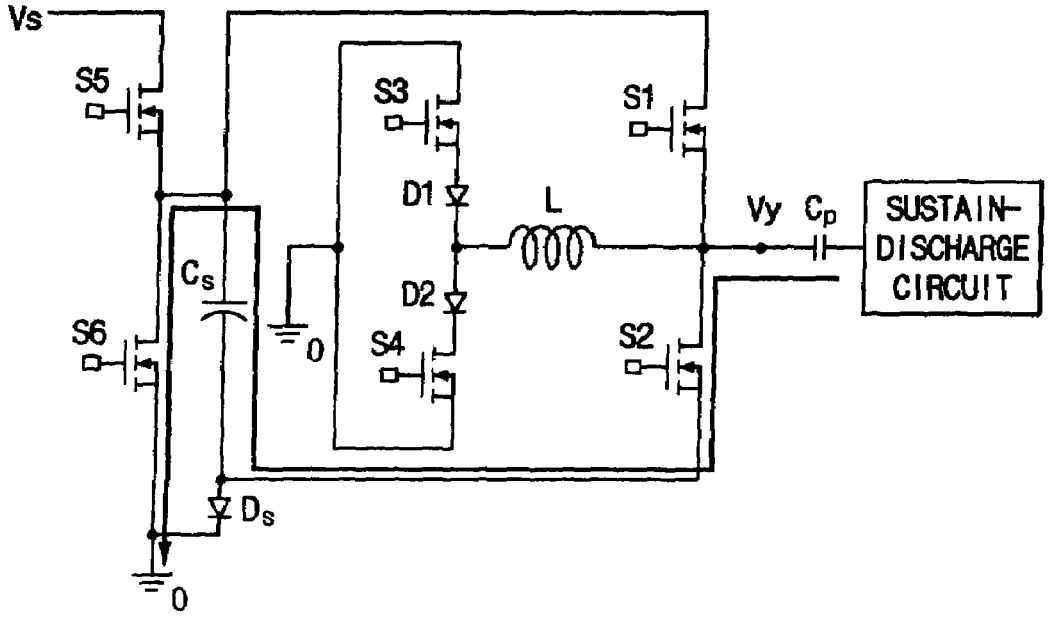

In a mode 8 (M8), as shown in FIG. 12H, Y electrode voltage Vy is continuously sustained to be −Vs by continuously turning on switching elements S2 and S6 and switching element S4 is turned off when current $I_L$ that flows through the inductor decreases to 0A.

As described above, in the fourth embodiment of the present invention, power is consumed in order to accumulate energy in the inductor in the modes 1 and 5. However, power is charged to power Vs and capacitor Cs in the modes 3 and 7. Therefore, because the consumed power is ideally equal to the charged power, the totally consumed power becomes 0W. Accordingly, it is possible to change the voltage of the panel capacitor without power consumption.

In the fourth embodiment of the present invention, switching element S7 can be used instead of diode Ds. In this case, switching element S7 is turned on when switching element S5 is turned on so that capacitor Cs is continuously charged to voltage Vs.

In the third and fourth embodiments of the present invention, two inductors L1 and L2 can be used as in the first and second embodiments (Refer to FIGS. 7 and 8). That is, inductor L1 is used in the path formed from ground to panel capacitor Cp. Inductor L2 is used in the path formed from one end of panel capacitor Cp to ground. When the inductors of two directions vary, it is possible to set the increasing time and the decreasing time of Y electrode voltage Vy of panel capacitor Cp to be different from each other.

Other embodiments of the sustain-discharge circuit according to the first through fourth embodiments will be described with reference to FIGS. 13 through 29.

FIGS. 13 through 29 show the sustain-discharge circuits according to the embodiments of the present invention. The sustain-discharge circuits shown in FIGS. 13 through 24 are obtained by modifying the sustain-discharge circuit according to the first or third embodiment of the present invention. The sustain-discharge circuits shown in FIGS. 25 through 29 are obtained by modifying the sustain-discharge circuit according to the second or fourth embodiment of the present invention.

Figure 13:
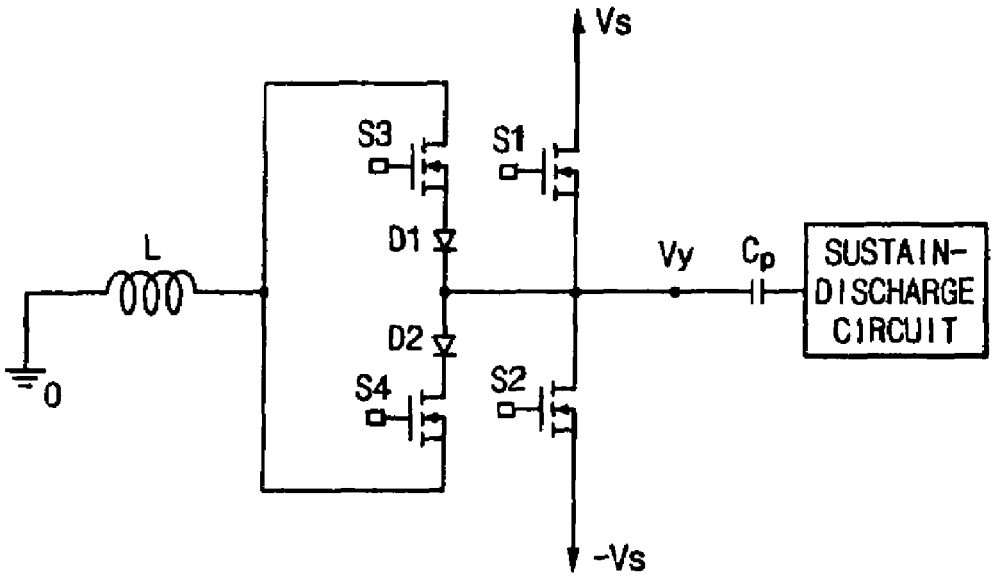
FIGS. 13 through 29, and 31 show PDP sustain-discharge circuits according to further embodiments of the present invention.

Referring to FIG. 13, the sustain-discharge circuit according to another embodiment of the present invention is the same as that of the first or third embodiment excepting the position of inductor L. Inductor L is connected between the contact point of switching elements S3 and S4 and ground.

Figure 14:
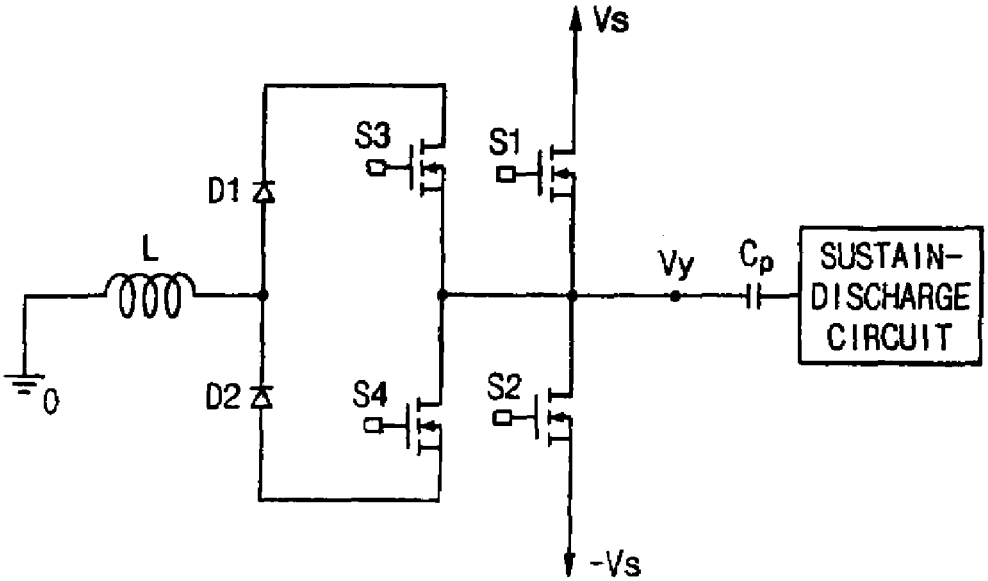

Referring to FIG. 14, the sustain-discharge circuit according to another embodiment of the present invention is the same as that of the embodiment shown in FIG. 13 excepting the positions of diodes D1 and D2. That is, diodes D1 and D2 are connected to each other between switching elements S3 and S4 and inductor L.

Figure 15:
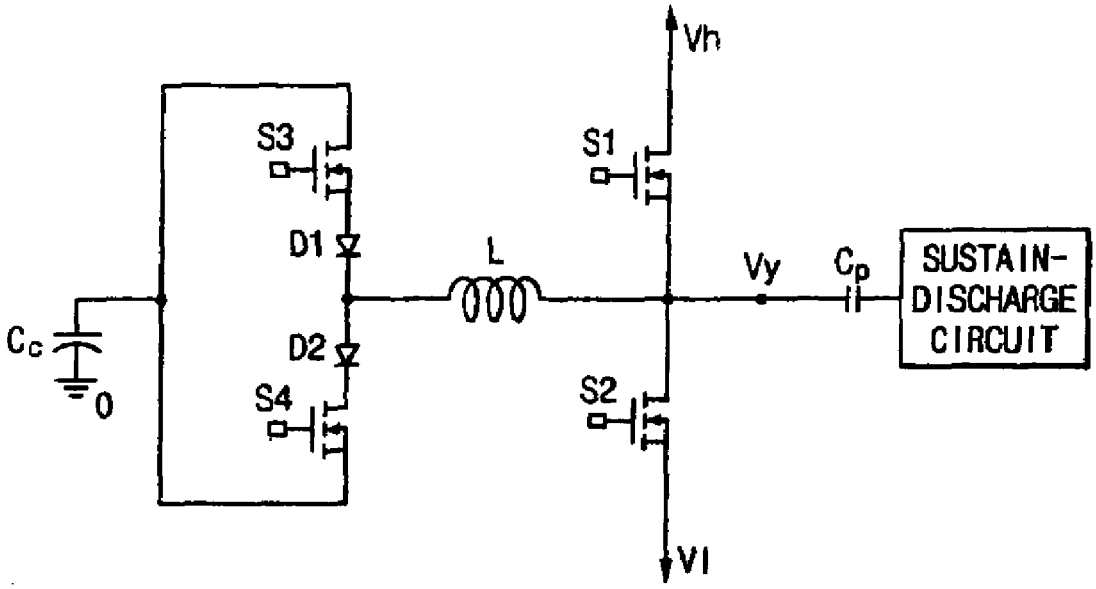
Figure 16:
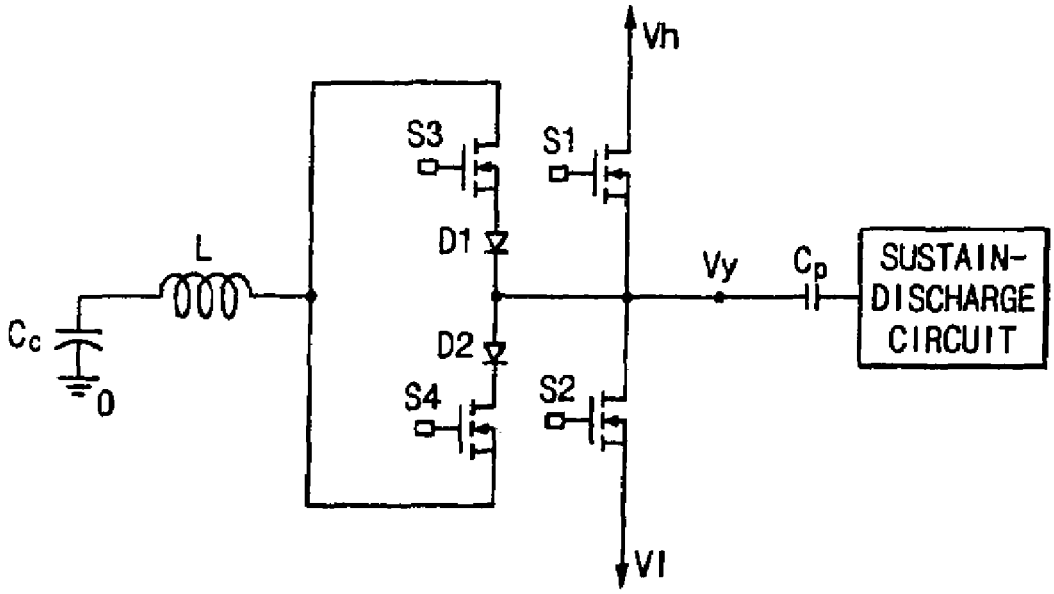
Figure 17:
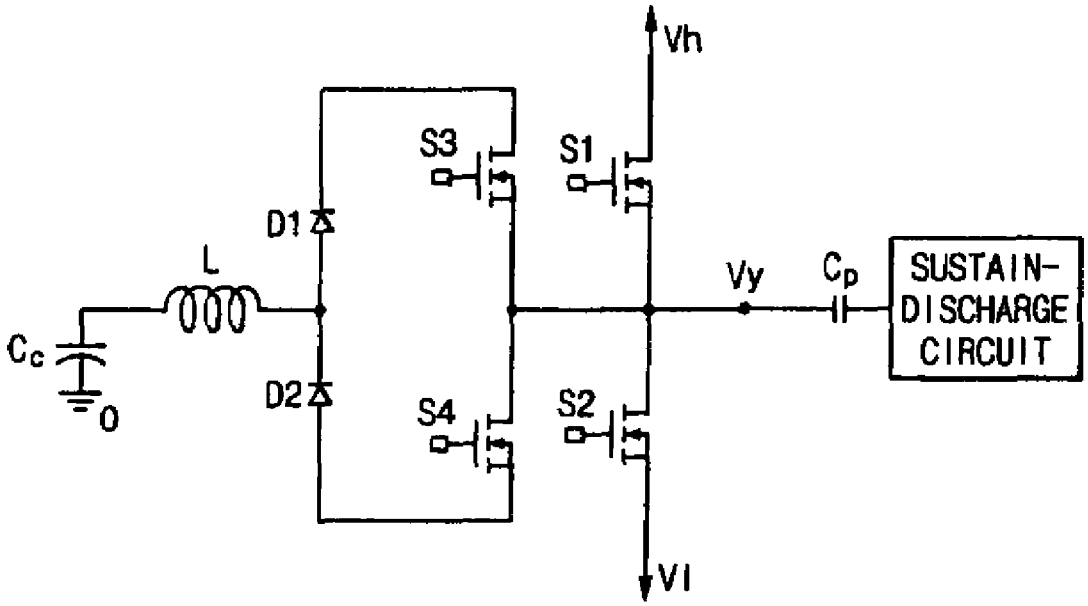

Referring to FIGS. 15 through 17, the sustain-discharge circuits according to other embodiments of the present invention are the same as those of the embodiments shown in FIGS. 2, 13, and 14 excepting voltage magnitudes VH and VL of two power sources and power recovery capacitor Cs. To be more specific, the voltage magnitudes of a first sustain power source and a second sustain power source are different from each other in the sustain-discharge circuits shown in FIGS. 15 through 17. When the voltage magnitudes of two power sources are different from each other, power recovery capacitor Cc exists. Accordingly, the voltage of (VH+VL)/2 must be charged to capacitor Cc.

Figure 18:
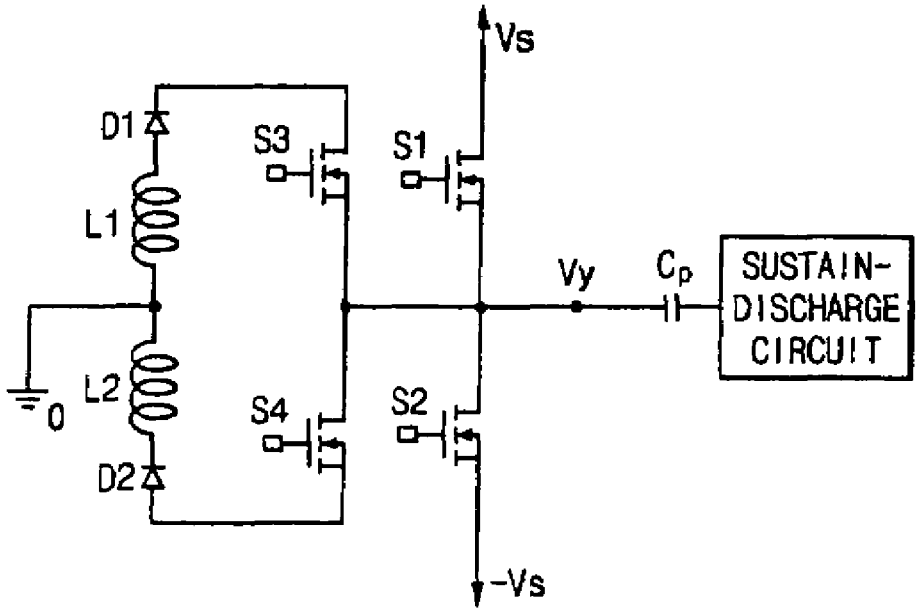
Figure 19:
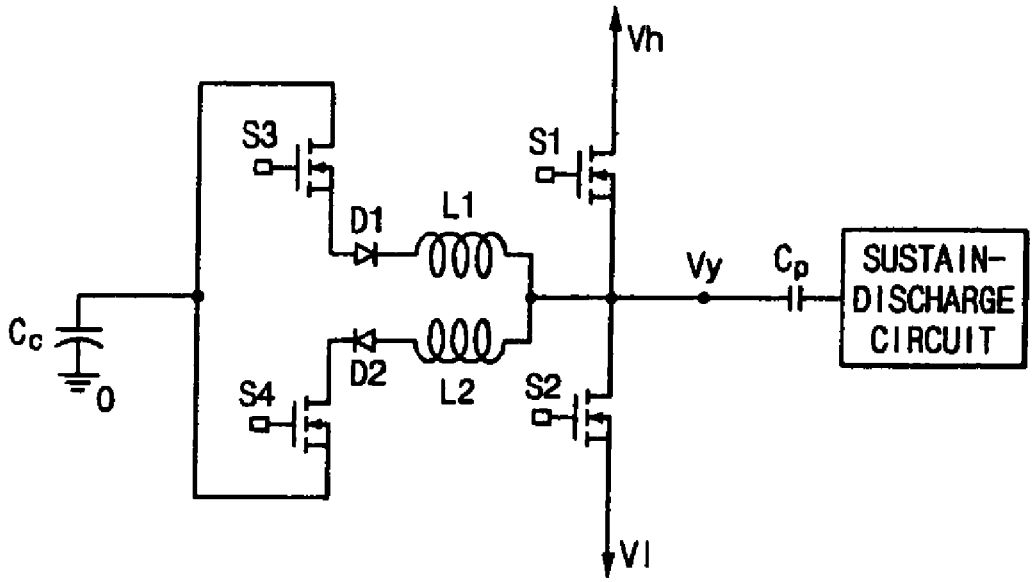
Figure 20:
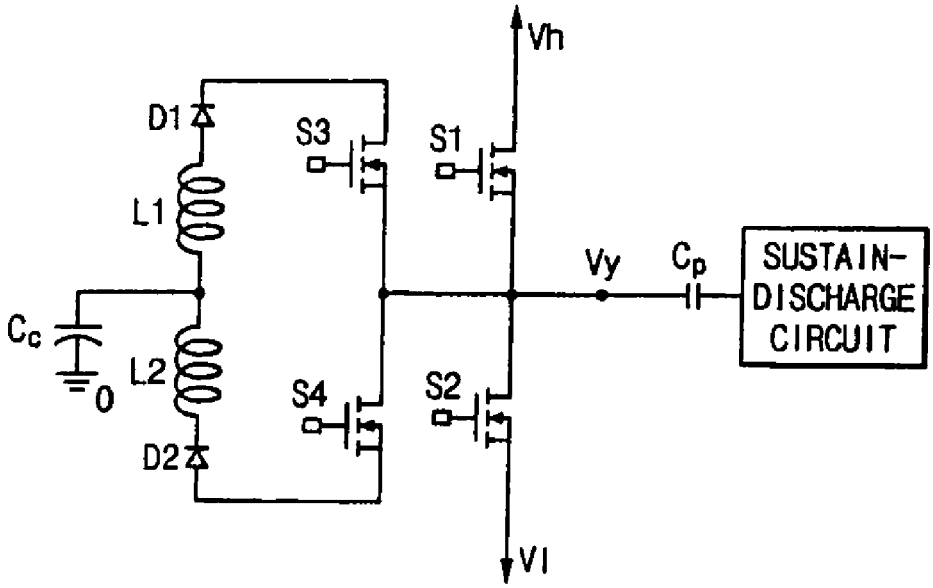
Figure 21:
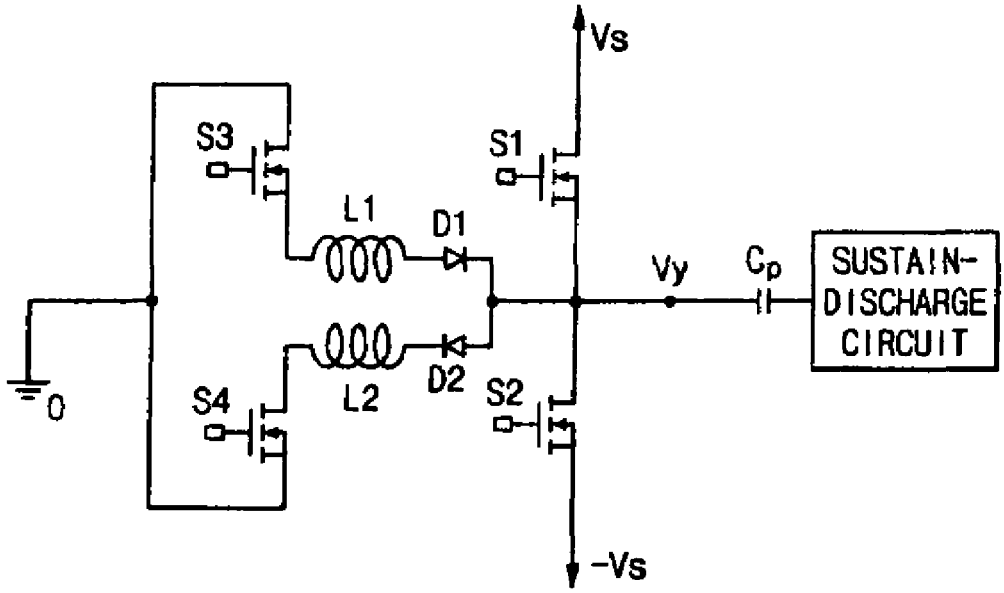
Figure 22:
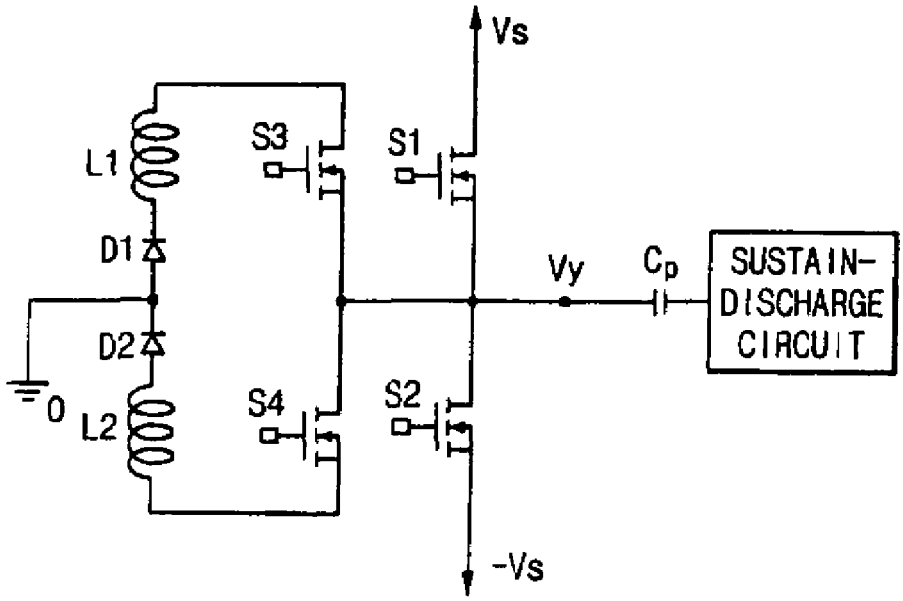
Figure 23:
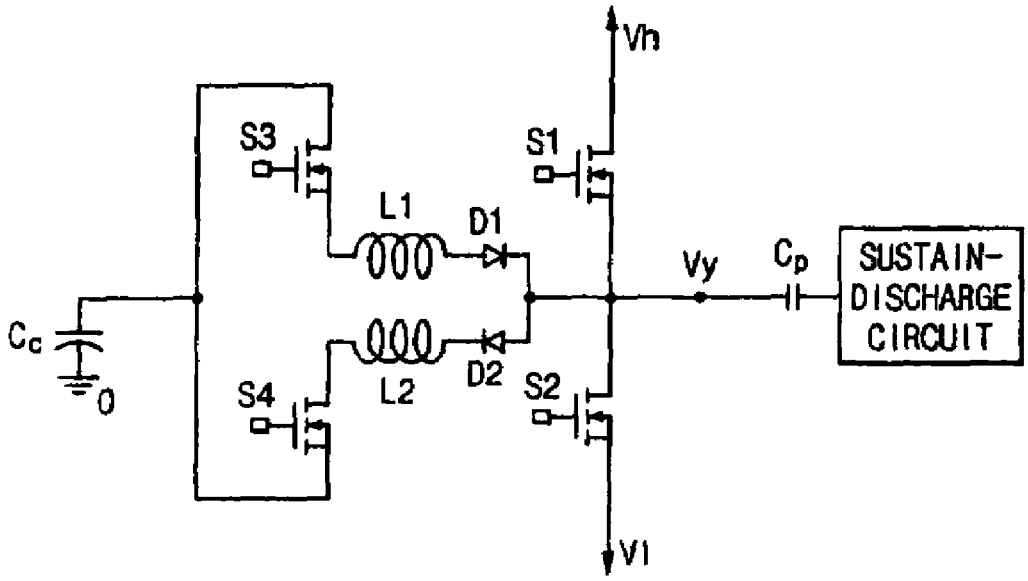
Figure 24:
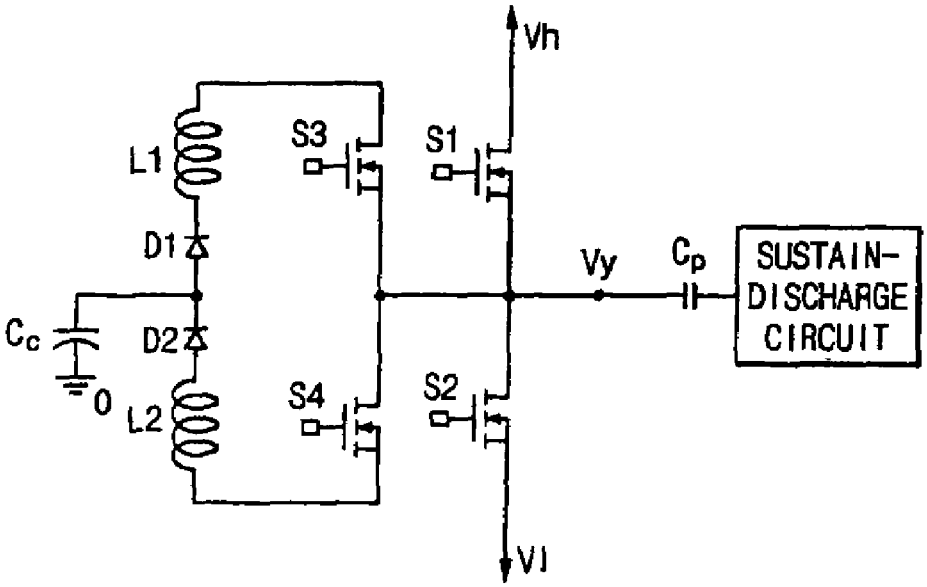

Referring to FIGS. 18 through 20, the sustain-discharge circuits according to other embodiments of the present invention are obtained by including two inductors L1 and L2 in the sustain-discharge circuits shown in FIGS. 14, 15, and 17.

Referring to FIGS. 21 through 24, the sustain-discharge circuits according to other embodiments of the present invention are obtained by changing the positions of inductors L1 and L2 into the positions of diodes D1 and D2 in the sustain-discharge circuits shown in FIGS. 7, 18, 19, and 20.

Figure 25:
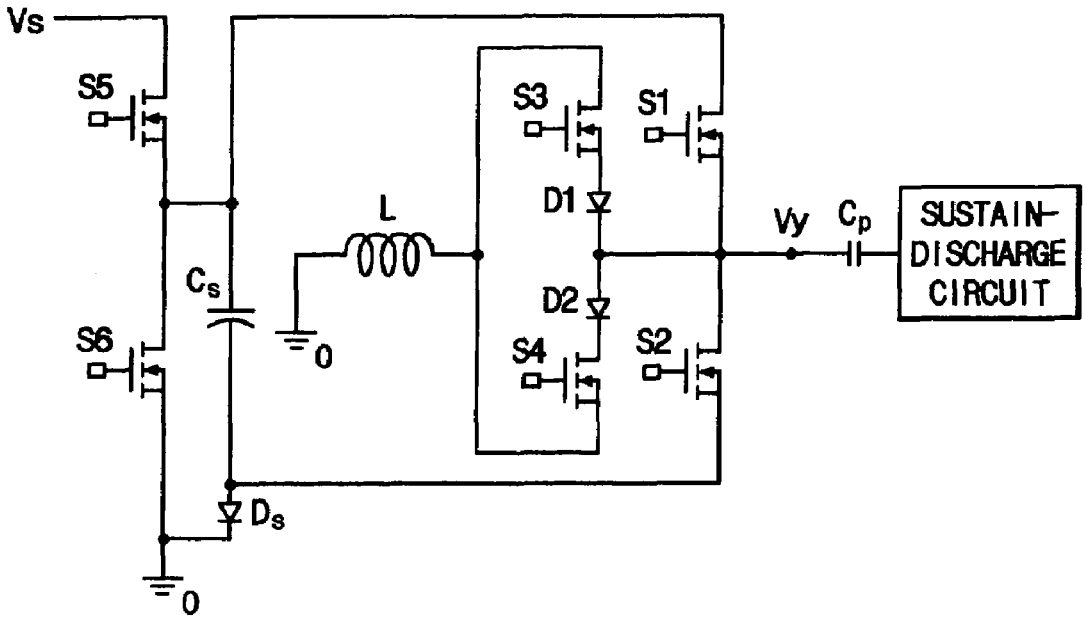
Figure 26:
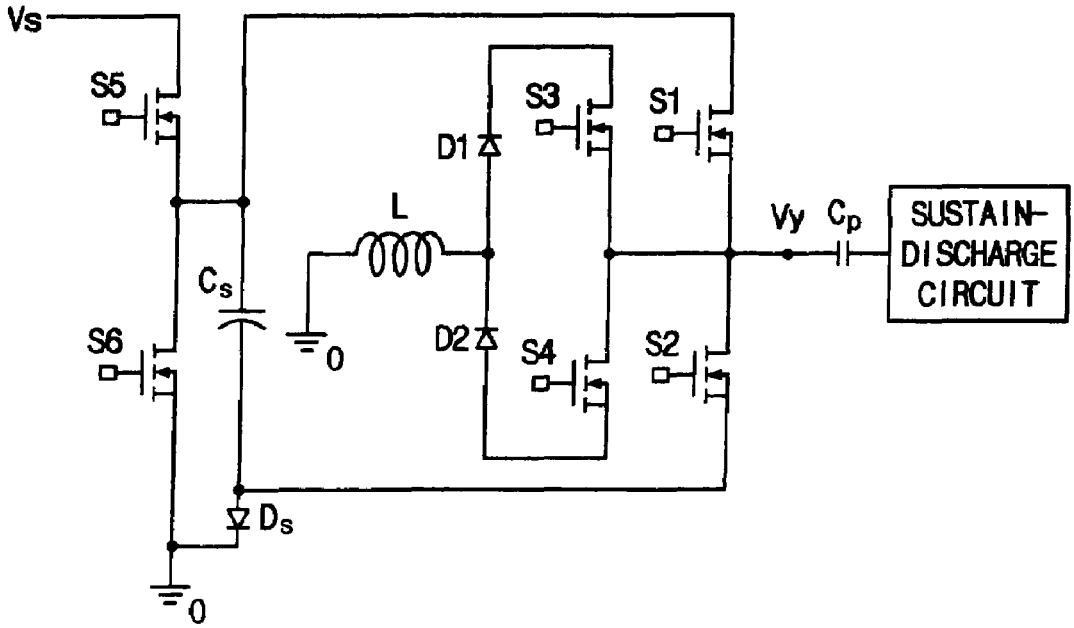

Referring to FIGS. 25 and 26, the sustain-discharge circuit according to another embodiment of the present invention shown in FIG. 25 is the same as the sustain-discharge circuit shown in FIG. 4 excepting the position of inductor L. The sustain-discharge circuit according to another embodiment of the present invention shown in FIG. 26 is the same as the sustain-discharge circuit shown in FIG. 25 excepting the positions of diodes D1 and D2.

Figure 27:
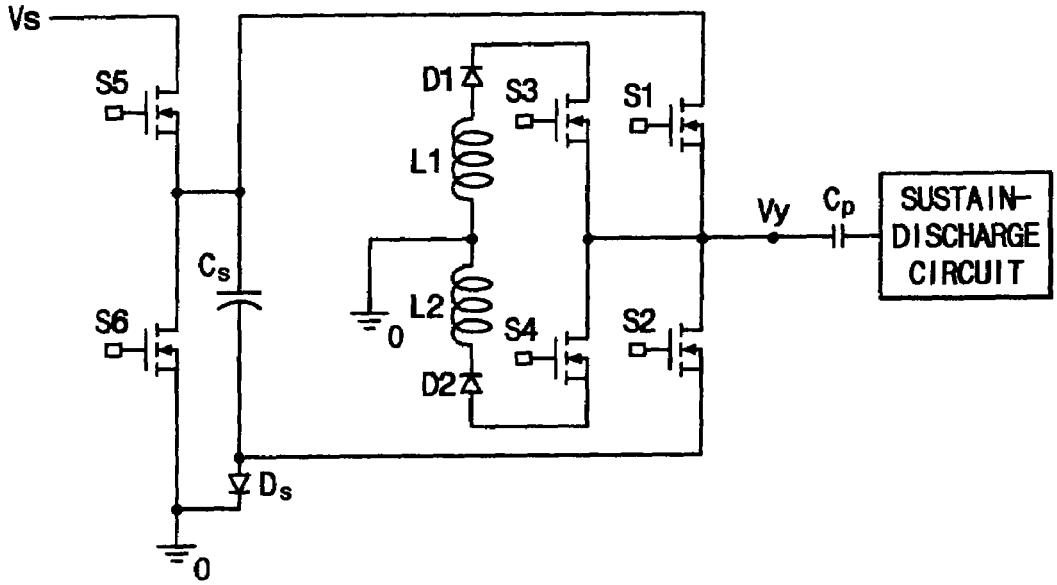
Figure 28:
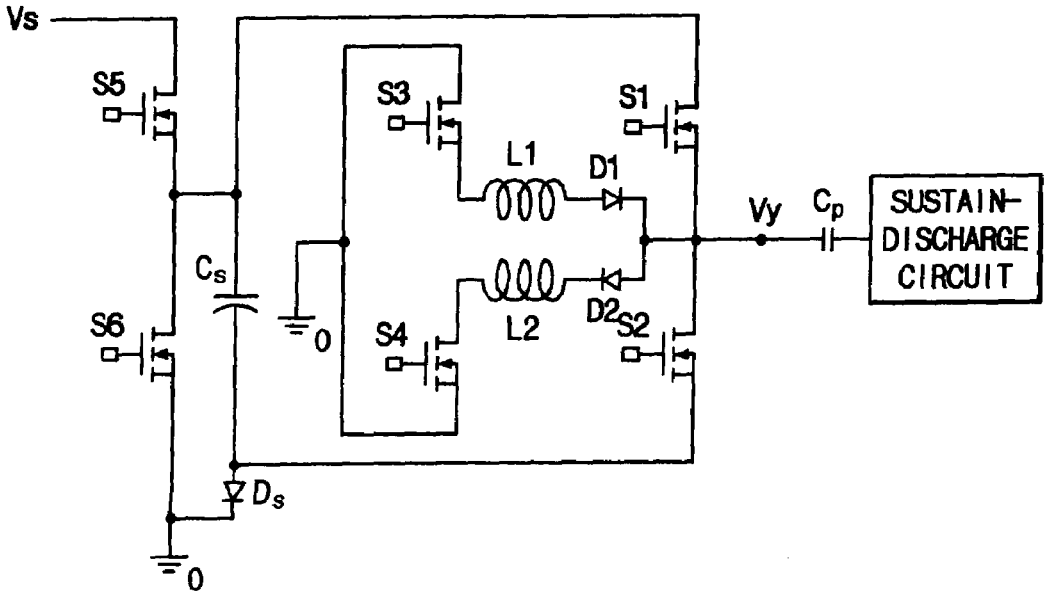
Figure 29:
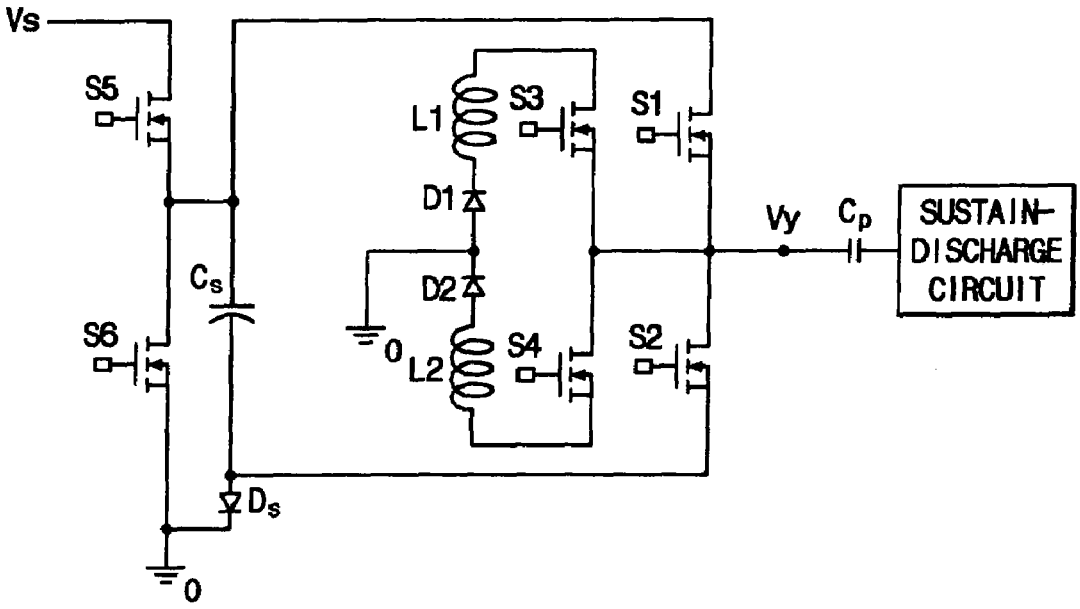

Referring to FIGS. 27 through 29, the sustain-discharge circuit according to another embodiment of the present invention shown in FIG. 27 is obtained by including two inductors L1 and L2 in the sustain-discharge circuit shown in FIG. 26. The sustain-discharge circuits according to other embodiments of the present invention shown in FIGS. 28 and 29 are obtained by changing the positions of inductors L1 and L2 into the positions of diodes D1 and D2 in the sustain-discharge circuits according to the embodiments shown in FIGS. 8 and 27.

Methods for driving the sustain-discharge circuits according to other embodiments of the present invention can be easily known with reference to descriptions according to the first through fourth embodiments. Therefore, descriptions thereof will be omitted.

The voltage applied to the Y electrodes of the panel is described in the embodiments of the present invention. However, as mentioned above, the circuit applied to the Y electrodes is applied to the X electrodes. Also, when the applied voltage is changed, the circuit can be applied to an address electrode.

As mentioned above, the sustain-discharge circuit of the PDP according to the present invention can recover power without using a power recovery capacitor having a large capacitance outside the sustain-discharge circuit. Also, because the zero voltage switching can be performed when the parasitic component exists in the circuit, the turn-on loss of the switching element is reduced.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. A plasma display panel comprising:

a plurality of electrodes;

a first transistor having a first transistor first terminal coupled to a power source and a first transistor second terminal coupled to the plurality of electrodes;

a second transistor having a second transistor first terminal and a second transistor second terminal, the second transistor first terminal being coupled to the plurality of electrodes;

a first inductor having a first inductor first terminal and a first inductor second terminal, the first inductor second terminal being coupled to the plurality of electrodes;

a second inductor having a second inductor first terminal and a second inductor second terminal, the second inductor second terminal being coupled to the plurality of electrodes;

a third transistor having a third transistor first terminal DC coupled to a ground terminal and a third transistor second terminal coupled to the first inductor first terminal;

a fourth transistor having a fourth transistor first terminal coupled to the second inductor first terminal and a fourth transistor second terminal DC coupled to the ground terminal;

a fifth transistor having a fifth transistor first terminal and a fifth transistor second terminal, the fifth transistor first terminal being coupled to the power source;

a sixth transistor having a sixth transistor first terminal coupled to the fifth transistor second terminal and a sixth transistor second terminal coupled to the ground terminal; and a capacitor having a first capacitor terminal coupled to the fifth transistor second terminal and the sixth transistor first terminal and a second capacitor terminal coupled to the second transistor second terminal and the ground terminal.

2. The plasma display panel of claim 1, wherein:

when the first transistor is turned on, a first voltage from the power source is applied to the plurality of electrodes; and when the second transistor and the sixth transistor are turned on, a ground voltage from the ground terminal is applied to the first capacitor terminal and a second voltage from the second capacitor terminal is applied to the plurality of electrodes.

3. The plasma display panel of claim 2, wherein the first voltage is a positive voltage, and the second voltage is a negative voltage.

4. The plasma display panel of claim 1, further comprising a diode having an anode coupled to the second capacitor terminal and a cathode coupled to the ground terminal.

5. The plasma display panel of claim 1, further comprising a seventh transistor having a seventh transistor first terminal coupled to the second capacitor terminal and a seventh transistor second terminal coupled to the ground terminal.

6. The plasma display panel of claim 1, further comprising:

a first diode having a first diode anode coupled to the third transistor second terminal and a first diode cathode coupled to the first inductor first terminal; and a second diode having a second diode anode coupled to the second inductor first terminal and a second diode cathode coupled to the fourth transistor first terminal.

7. A plasma display panel comprising:

a plurality of electrodes;

a first transistor having a first transistor first terminal coupled to a power source and a first transistor second terminal coupled to the plurality of electrodes;

a second transistor having a second transistor first terminal and a second transistor second terminal, the second transistor first terminal being coupled to the plurality of electrodes;

a first component group comprising a first inductor, a third transistor, and a first diode coupled in series with an arbitrary sequence, wherein a first end of the first component group is coupled to the plurality of electrodes and a second end of the first component group is DC coupled to a ground terminal;

a second component group comprising a second inductor, a fourth transistor, and a second diode coupled in series with an arbitrary sequence, wherein a first end of the second component group is coupled to the plurality of electrodes and a second end of the second component group is DC coupled to the ground terminal;

a fifth transistor having a fifth transistor first terminal and a fifth transistor second terminal, the fifth transistor first terminal being coupled to the power source;

a sixth transistor having a sixth transistor first terminal coupled to the fifth transistor second terminal and a sixth transistor second terminal coupled to the ground terminal; and a capacitor having a first capacitor terminal coupled to the fifth transistor second terminal and the sixth transistor first terminal and a second capacitor terminal coupled to the second transistor second terminal and the ground terminal.

8. The plasma display panel of claim 7, wherein:

when the first transistor is turned on, a first voltage from the power source is applied to the plurality of electrodes; and when the second transistor and the sixth transistor are turned on, a ground voltage from the ground terminal is applied to the first capacitor terminal and a second voltage from the second capacitor terminal is applied to the plurality of electrodes.

9. The plasma display panel of claim 8, wherein the first voltage is a positive voltage, and the second voltage is a negative voltage.

10. The plasma display panel of claim 7, further comprising a third diode having an anode coupled to the second capacitor terminal and a cathode coupled to the ground terminal.

11. The plasma display panel of claim 7, further comprising a seventh transistor having a seventh transistor first terminal coupled to the second capacitor terminal and a seventh transistor second terminal coupled to the ground terminal.

12. A plasma display panel comprising:

a plurality of electrodes;

a first transistor having a first transistor first terminal coupled to a power source and a first transistor second terminal coupled to the plurality of electrodes;

a second transistor having a second transistor first terminal and a second transistor second terminal, the second transistor first terminal being coupled to the plurality of electrodes;

a first component group comprising an inductor, a third transistor and a first diode coupled in series with an arbitrary sequence, wherein a first end of the first component group is coupled to the plurality of electrodes and a second end of the first component group is DC coupled to a ground terminal;

a second component group comprising the inductor, a fourth transistor and a second diode coupled in series with an arbitrary sequence, wherein a first end of the second component group is coupled to the plurality of electrodes and a second end of the second component group is DC coupled to the ground terminal;

a fifth transistor having a fifth transistor first terminal and a fifth transistor second terminal, the fifth transistor first terminal being coupled to the power source;

a sixth transistor having a sixth transistor first terminal coupled to the fifth transistor second terminal and a sixth transistor second terminal coupled to the ground terminal; and a capacitor having a first capacitor terminal coupled to the fifth transistor second terminal and the sixth transistor first terminal and a second capacitor terminal coupled to the second transistor second terminal and the ground terminal.

13. The plasma display panel of claim 12, wherein:

when the first transistor is turned on, a first voltage from the power source is applied to the plurality of electrodes; and when the second transistor and the sixth transistor are turned on, a ground voltage from the ground terminal is applied to the first capacitor terminal and a second voltage from the second capacitor terminal is applied to the plurality of electrodes.

14. The plasma display panel of claim 13, wherein the first voltage is a positive voltage, and the second voltage is a negative voltage.

15. The plasma display panel of claim 12, further comprising a third diode having an anode coupled to the second capacitor terminal and a cathode coupled to the ground terminal.

16. The plasma display panel of claim 12, further comprising a seventh transistor having a seventh transistor first terminal coupled to the second capacitor terminal and a seventh transistor second terminal coupled to the ground terminal.

* * * * *